US007113724B2

(12) United States Patent
Park et al.

(10) Patent No.: US 7,113,724 B2
(45) Date of Patent: Sep. 26, 2006

(54) TANDEM COLOR IMAGE FORMING DEVICE

(75) Inventors: Ki-ju Park, Yongin-si (KR); Hyo-jin Lee, Suwon-si (KR); Il-kwon Kang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 150 days.

(21) Appl. No.: 10/852,156

(22) Filed: May 25, 2004

(65) Prior Publication Data

US 2005/0002690 A1 Jan. 6, 2005

(30) Foreign Application Priority Data

Jul. 3, 2003 (KR) ..... 10-2003-0045044

(51) Int. Cl.
*G03G 15/01* (2006.01)
*G03G 21/18* (2006.01)

(52) U.S. Cl. ..... 399/112; 399/111; 399/299

(58) Field of Classification Search ..... 399/112, 399/299, 223, 298, 302; 347/115, 138, 152
See application file for complete search history.

(56) References Cited

U.S. PATENT DOCUMENTS 6,101,349 A * 8/2000 Ohashi et al. ..... 399/112
6,484,003 B1 * 11/2002 Tokutake et al. ..... 399/112
6,647,227 B1 * 11/2003 Yokoi et al. ..... 399/111
2003/0053819 A1 * 3/2003 Nomura et al. ..... 399/112

FOREIGN PATENT DOCUMENTS

| | | | |
|---|---|---|---|
| JP | 10-142889 | | 5/1998 |
| JP | 2000-019928 | | 1/2000 |
| JP | 2002-108049 | | 4/2002 |
| JP | 2003-316105 | A * | 11/2003 |
| JP | 2004-070088 | A * | 3/2004 |
| KR | 0190166 | | 1/1999 |
| KR | 2000-0004726 | | 3/2000 |

* cited by examiner

*Primary Examiner*—Sophia S. Chen
(74) *Attorney, Agent, or Firm*—Roylance, Abrams, Berdo & Goodman, LLP

(57) ABSTRACT

A color image forming device has an image forming cartridge including a cartridge frame that receives a plurality of image forming units. A movable fixing part supports at least one of the shafts of a plurality of photosensitive bodies disposed in the image forming units so that the shaft is rotatably fixed. The shafts of the other photosensitive bodies are movable and rotatable when the plurality of image forming units are received in the cartridge frame. A mounting frame receives the image forming cartridge, and has a shaft receiving part formed at a position corresponding to the ends of the shafts of the photosensitive bodies. The color image forming device accurately fixes the position of the shafts of the photosensitive bodies when the image forming cartridge is assembled in the mounting frame, thereby producing a high quality image reliably.

19 Claims, 16 Drawing Sheets

TANDEM COLOR IMAGE FORMING DEVICE

CROSS-REFERENCE TO RELATED APPLICATIONS

This application claims priority from Korean Patent Application No. 2003-45044, filed on Jul. 3, 2003, in the Korean Intellectual Property Office, the entire contents of which are incorporated herein by reference.

BACKGROUND OF THE INVENTION

1. Field of the Invention

The present invention relates to an electrophotographic image forming device such as a printer, copier, and facsimile machine. More particularly, the present invention relates to a tandem color image forming apparatus to transfer toner images formed respectively on a plurality of photosensitive bodies by a plurality of corresponding image forming units, onto an intermediate transfer unit or printing medium.

2. Description of the Related Art

A conventional electrophotographic tandem color image forming device is provided with a plurality of image forming units disposed in parallel, a plurality of photosensitive bodies, each being disposed in the corresponding image forming units and forming toner images representing yellow, magenta, cyan and black colors, respectively, and a transfer unit such as a transfer belt or a transfer drum to sequentially transfer the toner images formed on the photosensitive bodies onto a recording medium such as a sheet of printing paper. Additionally, conventional electrophotographic tandem color image forming devices include a fusing unit to fuse and fix the toner images transferred onto the recording medium with heat and pressure.

Other conventional tandem color image forming devices further include an intermediate transfer unit disposed between the photosensitive bodies and the transfer unit. In this case, the toner images formed on the photosensitive bodies are not directly transferred to the recording medium, but are first transferred as a first transfer image onto the intermediate transfer unit and then retransferred from the intermediate transfer unit onto the recording medium.

The conventional tandem color image forming devices that have the plurality of photosensitive bodies therein for forming images by simultaneously revolving the plurality of photosensitive bodies have an advantage in that they can obtain color images very quickly, as compared with other color image forming devices that have only a single photosensitive body therein for forming images by revolving the single photosensitive body several times. Since construction is complicated with use of a plurality of photosensitive bodies and image forming units, it is important that the tandem color image forming device be constructed to be easily assembled, maintained and repaired.

FIGS. 1 and 2 show a tandem image forming device having a mounting frame for easily assembling, maintaining, and repairing. The tandem image forming device is disclosed in Japanese patent No. 2002-108049, the entire contents of which are incorporated herein by reference.

The color image forming device 1 comprises a paper feeding unit 21 to feed sheets of printing paper P stacked in a paper cassette 20, four image forming units 10Y, 10M, 10C and 10K to form toner images of four colors, i.e., yellow, magenta, cyan, and black disposed vertically in parallel, and an intermediate transfer unit 7 having a belt-shaped intermediate transfer element 70 (FIG. 5) rotatably supported on a plurality of rollers 71, 72, 73 and 74 (FIG. 5) at a left side of photosensitive bodies 1Y, 1M, 1C, and 1K disposed respectively in the image forming units 10Y, 10M, 10C and 10K. The color imaging forming device 1 further comprises a mounting frame 8 to install the image forming units 10Y, 10M, 10C and 10K and the intermediate transfer unit 7 therein, a transfer unit 5A to retransfer the toner images transferred on the intermediate transfer element 70 of the intermediate transfer unit 7 from the photosensitive bodies lY, 1M, 1C, and 1K, onto a sheet of printing paper, and a fusing unit 24 to fuse and fix the toner images transferred onto the sheet of printing paper with heat and pressure.

Each of the image forming units 10Y, 10M, 10C and 10K are provided with photosensitive body assemblies 11Y, 11M, 11C and 11K (FIG. 5) having photosensitive bodies 1Y, 1M, 1C and 1K, charging units 2Y, 2M, 2C and 2K and cleaning units 6Y, 6M, 6C and 6K, laser scanning units 3Y, 3M, 3C and 3K (see FIG. 2), and developing units 4Y, 4M, 4C and 4K, which are formed in the proximity of the circumferences of the photosensitive bodies 1Y, 1M, 1C and 1K.

The intermediate transfer unit 7 has primary transfer parts 5Y, 5M, 5C, and 5K pressing the photosensitive bodies 1Y, 1M, 1C, 1K at a predetermined pressure with the intermediate transfer element 70 interposed therebetween.

As shown in FIGS. 1–4, the mounting frame 8 is formed of a casing 81 constructed to be guided and projected forward along left and right supporting rails 82L and 82R of main body 1A, to install the image forming units 10Y, 10M, 10C and 10K and the intermediate transfer unit 7 into the main body 1A.

The casing 81 is provided with an upper cover member 83 to cover an upper portion of the photosensitive body assembly 11Y, and a lower cover member 84 to protect the intermediate transfer element 70 in mounting and dismounting of the intermediate transfer unit 7, and preferably to act as an upper guide of a paper conveying path (at the same time).

Vertical grooves 86 and horizontal grooves 85 are formed at inner surfaces of front and rear walls of the casing 81 to guide positioning pins 75 (FIG. 3) formed at both sides of the intermediate transfer unit 7 to install the intermediate transfer unit 7.

The casing 81 is provided with supports 87Y, 87M, 87C and 87K (FIG. 5) to support the photosensitive body assemblies 11Y, 11M, 11C and 11K including the photosensitive bodies 1Y, 1M, 1C and 1K, the charging units 2Y, 2M, 2C and 2K and the cleaning units 6Y, 6M, 6C and 6K in corresponding assembling positions, respectively. Supporting sliders 88Y, 88M, 88C and 88K (FIG. 3) receive and support the developing units 4Y, 4M, 4C and 4K in corresponding assembling positions, respectively.

Accordingly, in disassembling of the intermediate transfer unit 7 and the image forming units 10Y, 10M, 10C and 10K for maintenance and repair, the mounting frame 8 is guided and projected forward along the left and the right supporting rails 82L and 82R in the main body 1A, as shown in FIG. 1.

Subsequently, the intermediate transfer unit 7 is moved away from the photosensitive body assemblies and then lifted upwardly, as shown in FIG. 5. Durign the lifting procedure, the positioning pins 75 of the intermediate transfer unit 7 are guided along the horizontal grooves 85 and then vertically along the vertical grooves 86, so that the intermediate transfer unit 7 can be easily pulled out.

After pulling out the intermediate transfer unit 7, the photosensitive body assemblies 11Y, 11M, 11C and 11K and the developing units 4Y, 4M, 4C and 4K are moved and then pulled out in the directions shown by the arrows in FIG. 5 from the supports 87Y, 87M, 87C and 87K and the supporting sliders 88Y, 88M, 88C and 88K, respectively.

The procedure for assembling the intermediate transfer unit 7 and the image forming units 10Y, 10M, 10C and 10K into the mounting frame 8 is performed in the opposite order of disassembling them as described above.

The conventional tandem color image forming device 1 as described above has a mounting frame 8 that can easily assemble and disassemble the intermediate transfer unit 7 and the image forming units 10Y, 10M, 10C and 10K. To accurately mount the photosensitive body assemblies 11Y, 11M, 11C and 11K, however, and the developing units 4Y, 4M, 4C and 4K of the image forming units 10Y, 10M, 10C and 10K in position in the mounting frame 8, they should be fabricated to have dimensions that accurately coincide with those of the supports 87Y, 87M, 87C and 87K and the supporting sliders 88Y, 88M, 88C and 88K of the mounting frame 8, respectively.

Fabricating the dimensions in both side components to accurately coincide with one another as described above can complicate the design of the fabricating mold, and can induce assembling errors when assembling both of the side components.

Furthermore, in the conventional tandem color image forming device 1, the photosensitive body assemblies 11Y, 11M, 11C and 11K and the developing units 4Y, 4M, 4C and 4K should be exactly and individually mounted on assembling positions in the mounting frame 8. This is difficult to achieve, and causes assembling efficiency to decrease and increases assembling time, thereby lowering manufacturing productivity.

SUMMARY OF THE INVENTION

It is, therefore, an aspect of the present invention to provide a tandem color image forming device having an image forming cartridge to modularize a plurality of image forming units in a body.

It is another aspect of the present invention to provide a tandem color image forming device having an image forming cartridge in which a plurality of image forming units are modularized in a body, and in which when it is assembled in a mounting frame formed in a main body, center shafts of photosensitive bodies disposed in the image forming units can be accurately fixed in position, thereby obtaining quality images consistently.

It is another aspect of the present invention to provide a tandem color image forming device having an image forming cartridge in which a plurality of image forming units are modularized in a body, and which by having at least a portion of center shafts of photosensitive bodies disposed in the image forming units, to be movable when it is assembled in a mounting frame formed in a main body, and to easily assemble and disassemble the center shafts of the photosensitive bodies in and from a corresponding shaft receiving part of the mounting frame, even though they are fabricated so as not to just join with the shaft receiving part, and thereby can be easily fabricated and assembled.

To achieve the above aspects and other features of the present invention, there is provided a tandem color image forming device comprising an image forming cartridge including a cartridge frame having a supporting part receiving a plurality of image forming units in parallel to modularize in a body, and a movable fixing part formed at the cartridge frame and supporting at least one of center shafts of photosensitive bodies disposed in the plurality of image forming units to be unmovable, but rotatable, and the rest of the center shafts of the photosensitive bodies to be movable and rotatable when the plurality of image forming units are received in the cartridge frame, and a mounting frame formed at a main body to mount the image forming cartridge therein, and having a shaft receiving part formed fixedly at a position corresponding to both ends of the center shafts of the photosensitive bodies of the image forming units to receive the both ends of the center shafts of the photosensitive bodies when the image forming cartridge is mounted in the mounting frame.

The movable fixing part can comprise fixed supporting holes formed at portions of the cartridge frame corresponding to both ends of the at least one of center shafts of the photosensitive bodies to fix both ends of the at least one of the center shafts of the photosensitive bodies to be unmovable, but rotatable, motion supporting holes formed at portions of the cartridge frame corresponding to both ends of the rest of the center shafts of the photosensitive bodies to fix both ends of the rest of the center shafts of the photosensitive bodies to be movable and rotatable, and a movable space formed between the image forming units corresponding to the both ends of the rest of the center shafts of the photosensitive bodies and the supporting part, and between the supporting part and the cartridge frame to enable the image forming units corresponding to both ends of the rest of the center shafts of the photosensitive bodies to move when both ends of the rest of the center shafts of the photosensitive bodies move.

It is preferable that the motion supporting holes are more magnified in at least one direction than the fixed supporting holes to enable the both ends of the rest of the center shafts of the photosensitive bodies to move in the same direction.

In another embodiment of the present invention, the fixed supporting holes are formed in the shape of circle, and the motion supporting holes are formed in a shape of one selected from the group consisting ¬-shaped form, a square form, a rectangle form, a circle form, a +-shaped form, a ⊥-shaped form, a ⊢-shaped form, and a ⊦-shaped form.

The supporting part preferably comprises at least one fixed support fixed at the cartridge frame to support the image forming unit corresponding to the at least one of the center shafts of the photosensitive bodies to be unmovable, and movable supports fixed at the cartridge frame to be rotatable through a predetermined angle on hinge shafts, and to support the image forming units corresponding to the rest of the center shafts of the photosensitive bodies to be movable.

The image forming cartridge preferably further comprises an elastic member elastically pressing the image forming units corresponding to the rest of the center shafts of the photosensitive bodies in at least one direction to assist moving of the image forming units corresponding to the rest of the center shafts of the photosensitive bodies in the at least one of the direction.

The elastic member can be comprised of a plurality of elastic springs disposed between the cartridge frame and the movable supports of the supporting part to move the image forming units corresponding to the rest of the center shafts of the photosensitive bodies in a first direction (preferably a Y axis), and a plurality of elastic springs disposed between the cartridge frame and a portion of the image forming units corresponding to the rest of the center shafts of the photosensitive bodies to move the portion of the image forming units corresponding to the rest of the center shafts of the photosensitive bodies in a second direction (preferably an X axis) that is preferably at a right angle to the first direction.

Both the elastic springs can be formed of an extension spring. Alternatively, the Y axis and X axis direction elastic springs can be formed of an extension spring and a compression spring, respectively.

The shaft receiving part can be comprised of a plurality of grooves opened in one direction and formed in a spaced-apart relation on an assembling reference line to align the both ends of the center shafts of the photosensitive bodies of the image forming units. The assembling reference line can preferably has a shape of one selected from the group consisting of a straight line and an arc.

According to another embodiment of the present invention, a tandem color image forming device comprises an image forming cartridge including a cartridge frame having a supporting part receiving a plurality of image forming units in parallel to modularize in a body, and a movable fixing part supporting at least one of center shafts of photosensitive bodies disposed in the plurality of image forming units to be unmovable, but rotatable, and the rest of the center shafts of the photosensitive bodies to be movable and rotatable. The tandem color image forming device further comprises a mounting frame formed at a main body to mount the image forming cartridge therein, and having a shaft receiving part formed fixedly at a position corresponding to both ends of the center shafts of the photosensitive bodies of the image forming units to receive the both ends of the center shafts of the photosensitive bodies when the image forming cartridge is mounted in the mounting frame.

The cartridge frame is preferably provided with a plurality of partition walls forming one of a plurality of compartments receiving the image forming units, respectively, and a plurality of compartments receiving components to form one image forming unit, respectively.

The movable fixing part is preferably comprised of fixed supporting holes formed at at least one of portions of the cartridge frame and portions of a frame of the image forming unit corresponding to both ends of the at least one of the center shafts of the photosensitive bodies to fix the both ends of the at least one of the center shafts of the photosensitive bodies to be unmovable, but rotatable, and motion supporting holes formed at at least one of portions of the cartridge frame and portions of frames of the image forming units corresponding to both ends of the rest of the center shafts of the photosensitive bodies to fix the both ends of the rest of the center shafts of the photosensitive bodies to be movable and rotatable.

It is preferable that the motion supporting holes be more magnified in at least one direction (X or Y axis) than the fixed supporting holes to enable the both ends of the rest of the center shafts of the photosensitive bodies to move in the at least one of the directions of the X axis and the Y axis.

In a preferred embodiment of the present invention, the fixed supporting holes are formed in the shape of a circle, and the motion supporting holes are formed in a shape of one selected from the group consisting of a ¬-shaped form, a square form, a rectangle form, a circle form, a +-shaped form, ⊥-shaped form, a ⊢-shaped form, and a |-shaped form.

The shaft receiving part can be comprised of a plurality of grooves opened in one direction and formed in a spaced-apart relation on an assembling reference line to align the both ends of the center shafts of the photosensitive bodies of the image forming units.

The assembling reference line preferably corresponds with either a line connecting the center shafts of the photosensitive bodies of the image forming units, or a line connecting center points of the fixed supporting holes and the motion supporting holes of the movable fixing part.

It is preferable that the assembling reference line has a shape selected from the group consisting of a straight line and an arc.

BRIEF DESCRIPTION OF THE DRAWING FIGURES

The above aspects, features and advantages of the present invention will become more apparent from the following detailed description when taken in conjunction with the accompanying drawing figures, in which.

Figure 15:
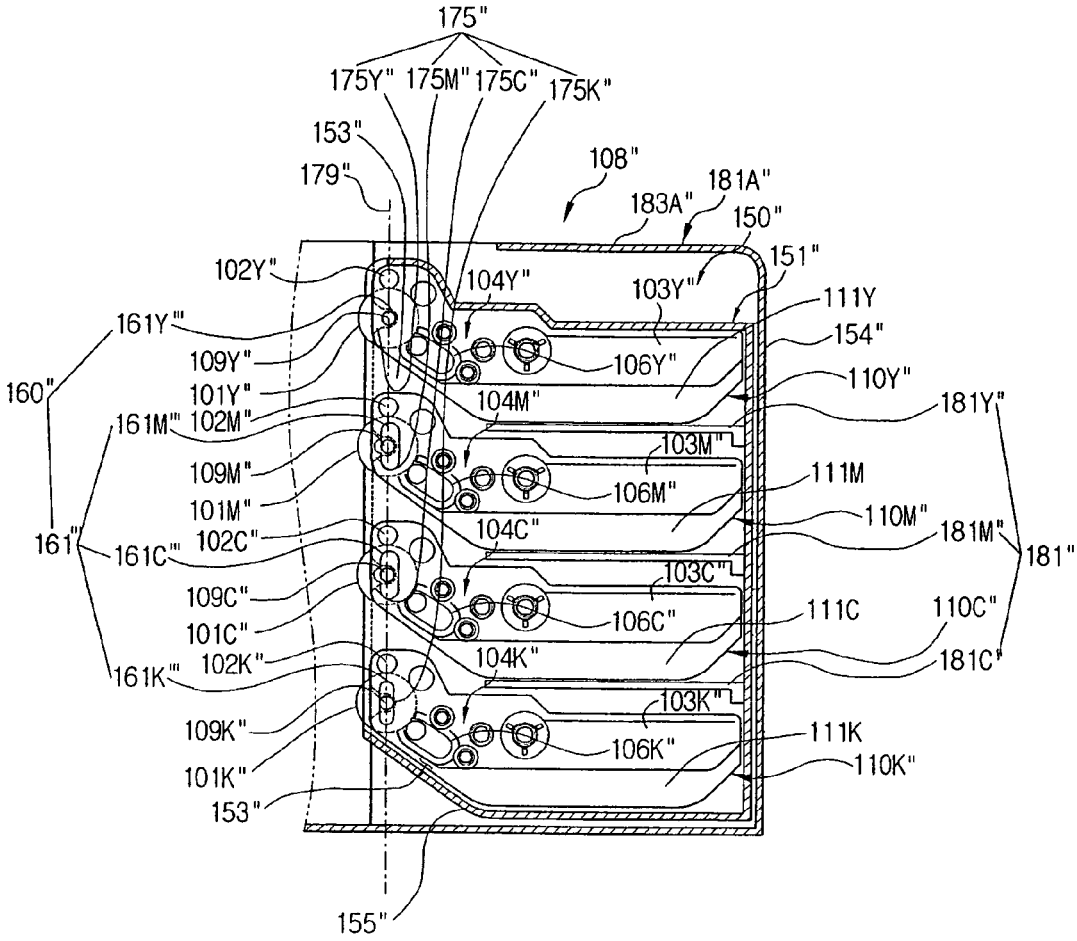
Figure 16:
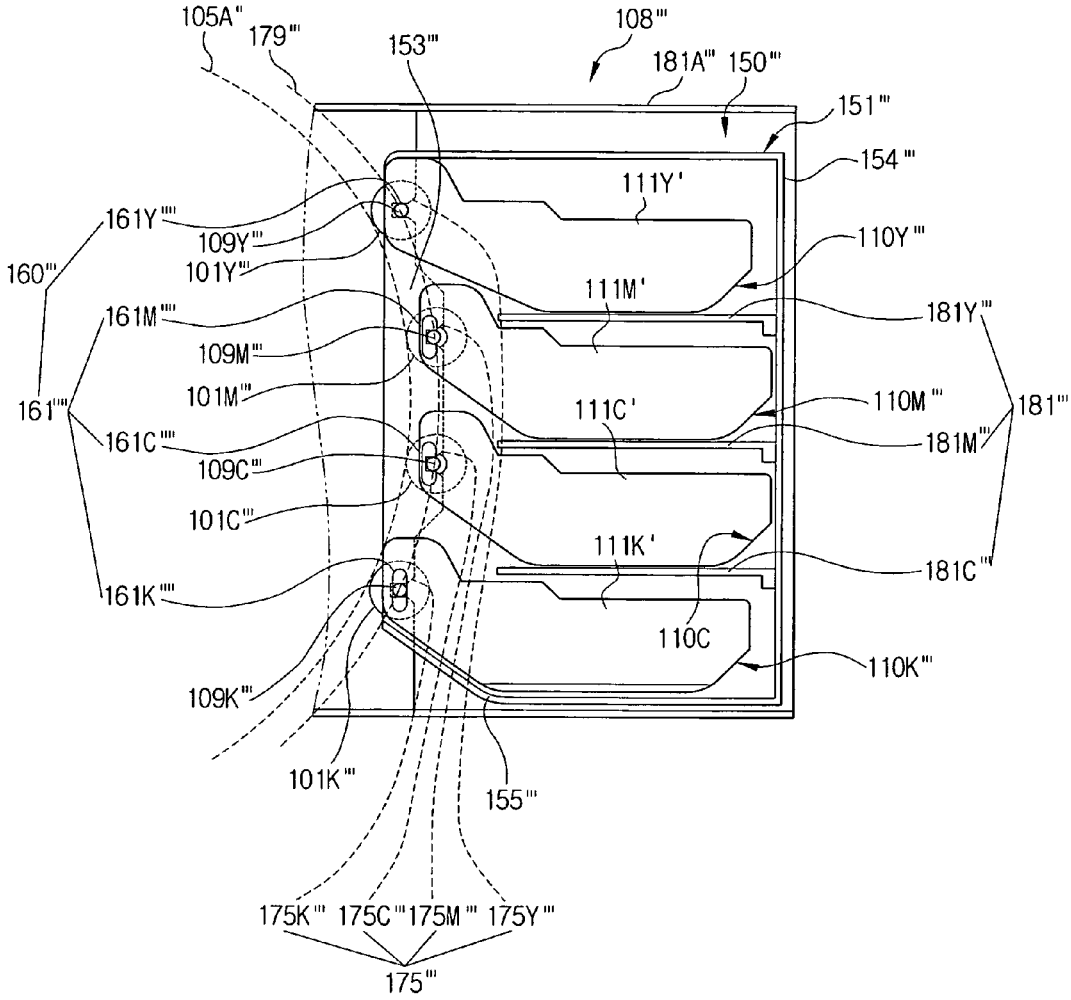

FIG. 15 is a partial cross sectional view of a color image forming device in accordance with a third preferred embodiment of the present invention, illustrating a state of an image forming cartridge assembled in a mounting frame; and FIG. 16 is a partial cross sectional view of a color image forming device in accordance with a fourth preferred embodiment of the present invention, illustrating a state of an image forming cartridge assembled in a mounting frame.

DETAILED DESCRIPTION OF THE PREFERRED EMBODIMENT

A tandem color image forming device according to several embodiments of the present invention will now be described with reference to the accompanying drawings.

Embodiment 1

Figure 6:
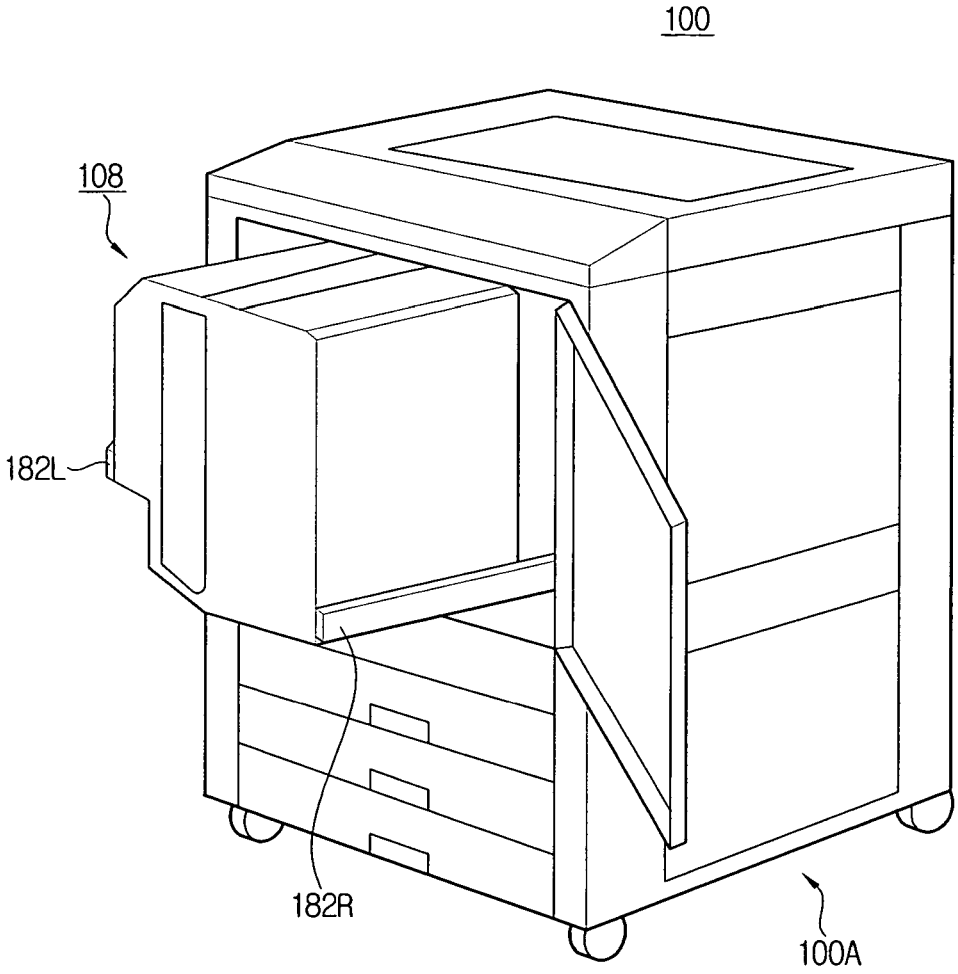
FIG. 6 is a perspective view illustrating a color image forming device in accordance with a first preferred embodiment of the present invention having a mounting frame projected therefrom.
Figure 7:
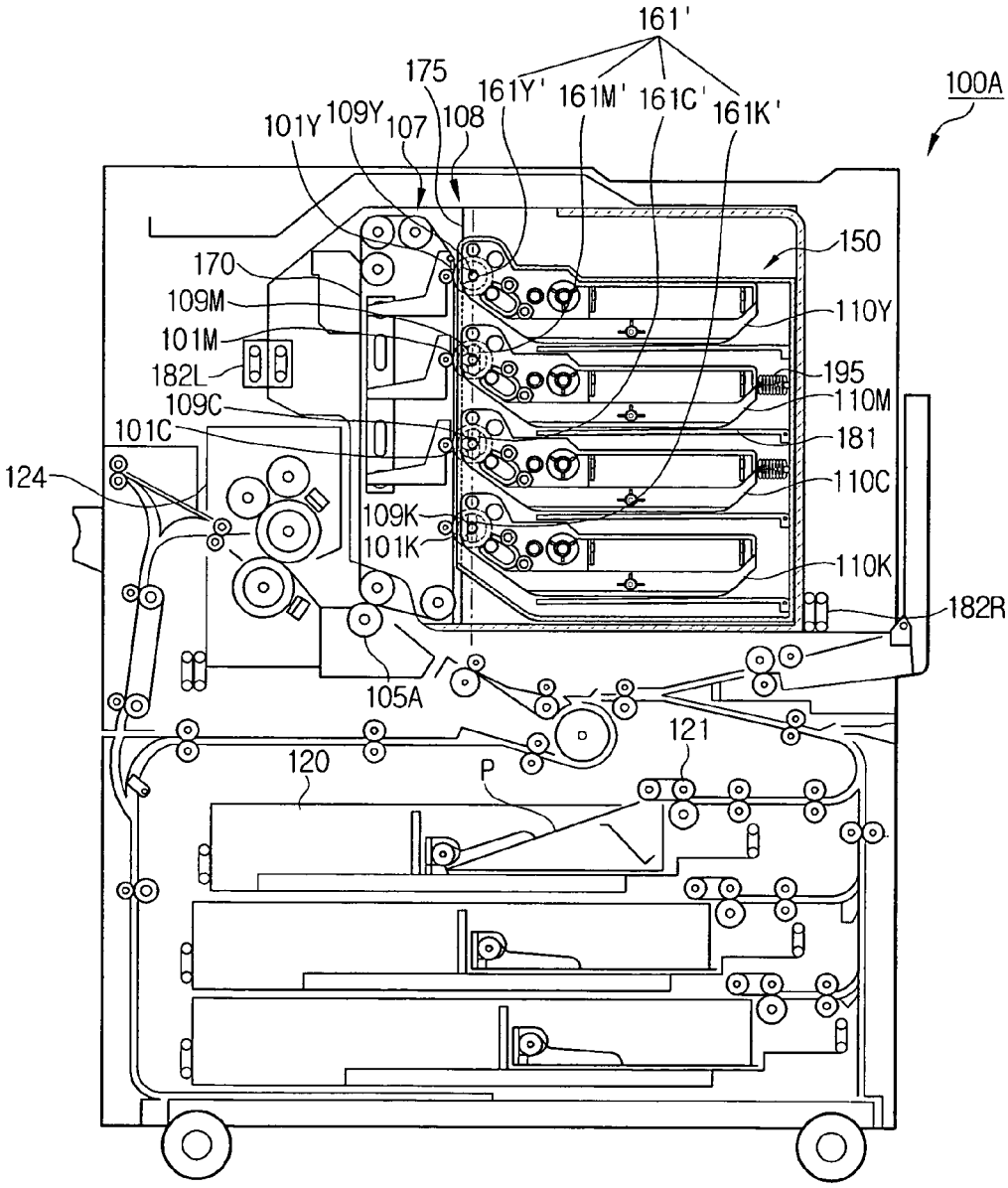
FIG. 7 is a cross sectional view of the image forming device shown in FIG. 6.
Figure 8:
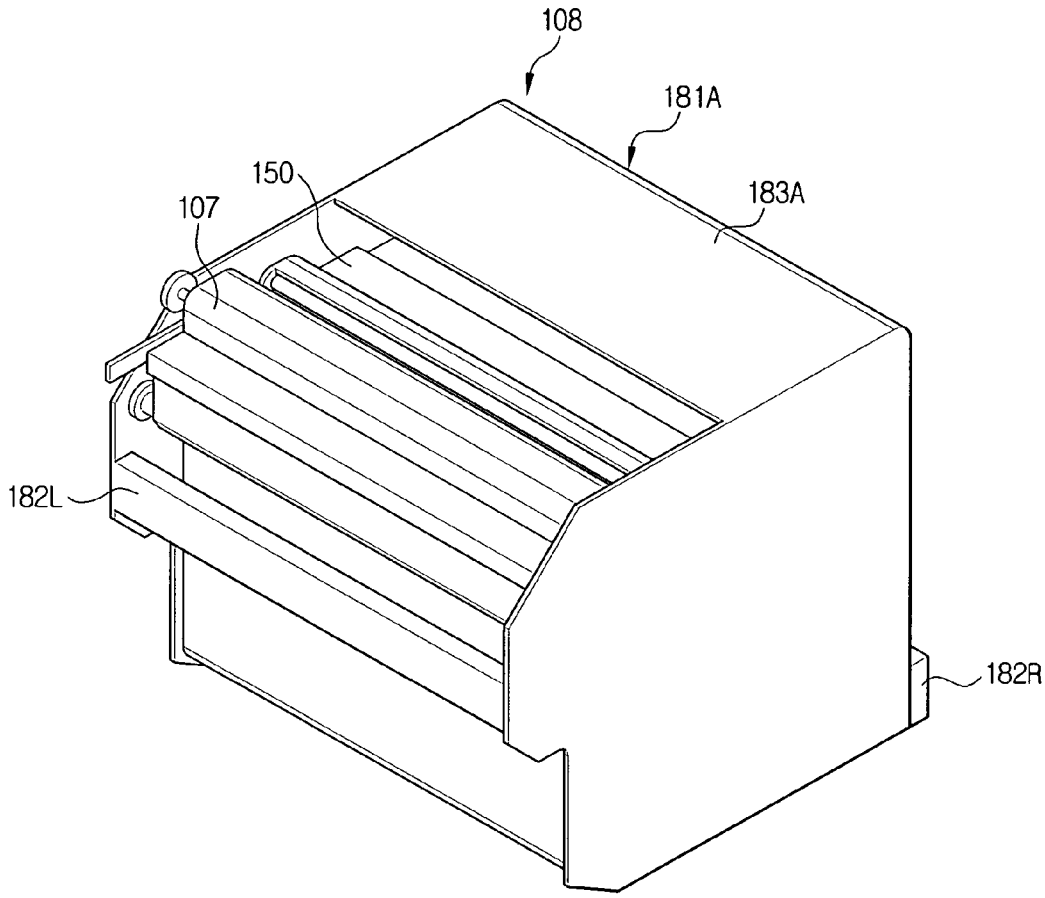
FIG. 8 is a perspective view of the mounting frame of the image forming device shown in FIG. 6, having a plurality of image forming units and an intermediate transfer unit mounted therein.

FIGS. 6 and 7 illustrate a tandem color image forming device 100 according to a first preferred embodiment of the present invention.

The tandem color image forming device 100 according to a first embodiment of the present invention comprises a paper feeding unit 121 to feed sheet of printing paper stacked in a paper cassette 120; an image forming cartridge 150 having first, second, third and fourth image forming units 110Y, 110M, 110C and 110K for forming toner images of four colors (typically yellow, magenta, cyan, and black) disposed vertically in parallel to be modularized in a body, and an intermediate transfer unit 107 having a belt-shaped intermediate transfer element 170 such as a photosensitive belt rotatably supported on plural rollers 171, 172, 173 and 174 (FIG. 11) at a left side of first, second, third and fourth drum-shaped photosensitive bodies 101Y, 101M, 101C, and 101K disposed respectively in the first, the second, the third and the fourth image forming units 110Y, 110M, 110C and 110K, and a primary transfer part 105Y, 105M, 105C, 105K transferring toner images formed on the first, the second, the third and the fourth photosensitive bodies 101Y, 101M, 101C, and 101K onto the intermediate transfer element 170. The tandem color image forming device 100 according to a first embodiment of the present invention further comprises a mounting frame 108 disposed to be guided by left and right supporting rails 182L and 182R in a main body 100A and installing the image forming cartridge 150 and the intermediate transfer unit 107 therein, a transfer unit 105A to retransfer the toner images transferred on the intermediate transfer element 170 of the intermediate transfer unit 107 from the first, the second, the third and the fourth photosensitive bodies 101Y, 101M, 101C, and 101K, onto a sheet of printing paper, and a fusing unit 124 to fuse and fix the toner images retransferred onto the sheet of printing paper with heat and pressure.

Figure 1:
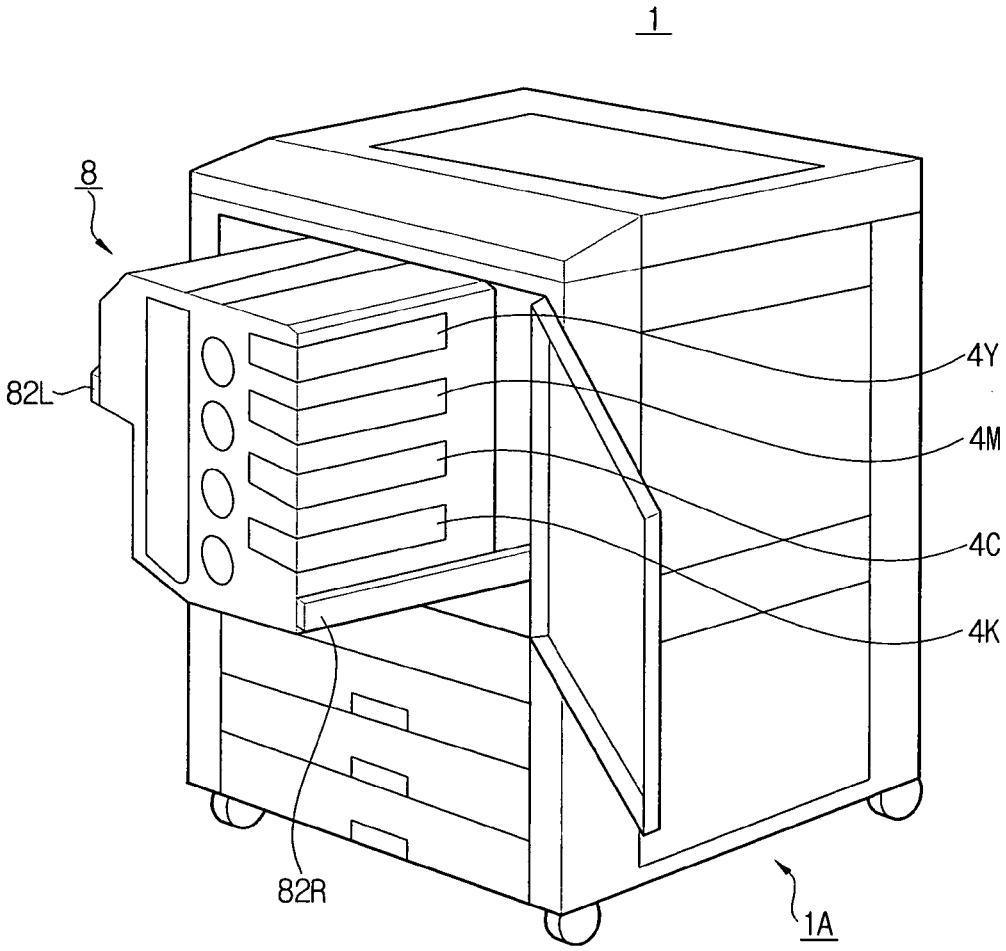
FIG. 1 (PRIOR ART)
FIG. 1 is a perspective view illustrating a conventional color image forming device having a mounting frame projected therefrom.

A description regarding the paper feeding unit 121, the intermediate transfer unit 107, the transfer unit 105A, and the fusing unit 124 among these components will be omitted here, as they are identical to that of the conventional ones described above with reference to FIG. 1.

Figure 10:
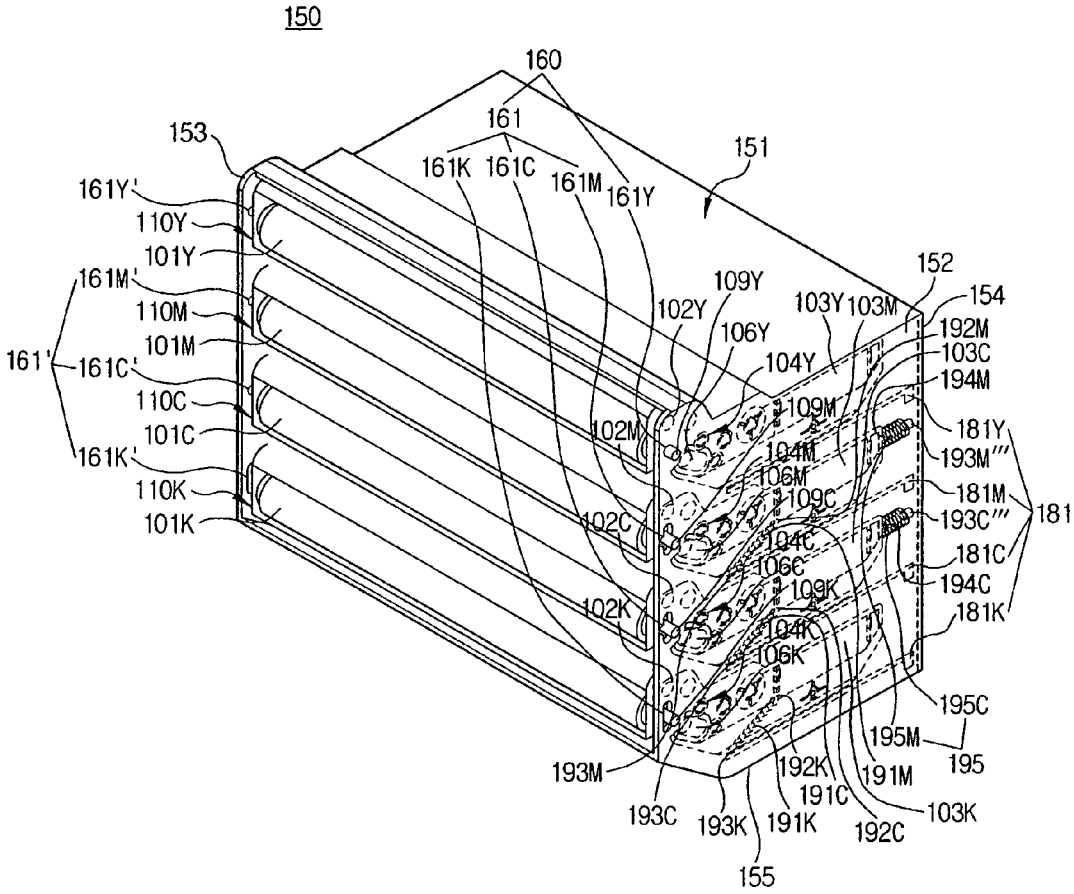
FIG. 10 is a perspective view of an image forming cartridge of the image forming device shown in FIG. 6.

As shown in FIG. 10, the image forming cartridge 150 includes a rectangular parallel piped-shaped cartridge frame 151 having a supporting part 181 receiving and supporting the first, second, third and fourth image forming units 110Y, 110M, 110C and 110K in a vertically spaced relation with one another to modularize them in a body, and a movable fixing part 160 supporting a first center shaft 109Y of the first photosensitive body 101Y of the first image forming units 110Y disposed at the uppermost, to be unmovable, but rotatable. The movable fixing part 160 also supports a second, third and fourth center shafts 109M, 109C and 109K of the second, third and fourth photosensitive bodies 101M, 101C and 101K of the second, third and fourth image forming units 110M, 110C and 110K to be movable and rotatable when the first, second, third and fourth image forming units 110Y, 110M, 110C and 110K are received in the cartridge frame 151.

The first, second, third and fourth image forming units 110Y, 110M, 110C and 110K modularized in a body in the image forming cartridge 150 are respectively provided with first, second, third and fourth photosensitive bodies 101Y, 101M, 101C and 101 K. The first, second, third and fourth image forming units 110Y, 110M, 110C and 110K are further respectively provided with first, second, third and fourth charging units 102Y, 102M, 102C and 102K, first, second, third and fourth cleaning units 106Y, 106M, 106C and 106K, first, second, third and fourth laser scanning units 103Y, 103M, 103C and 103K, and first, second, third and fourth developing units 104Y, 104M, 104C and 104K, which are disposed in a proximity of circumferences of the first, the second, the third and the fourth photosensitive bodies 101Y, 101M, 101C and 101K.

Figure 11:
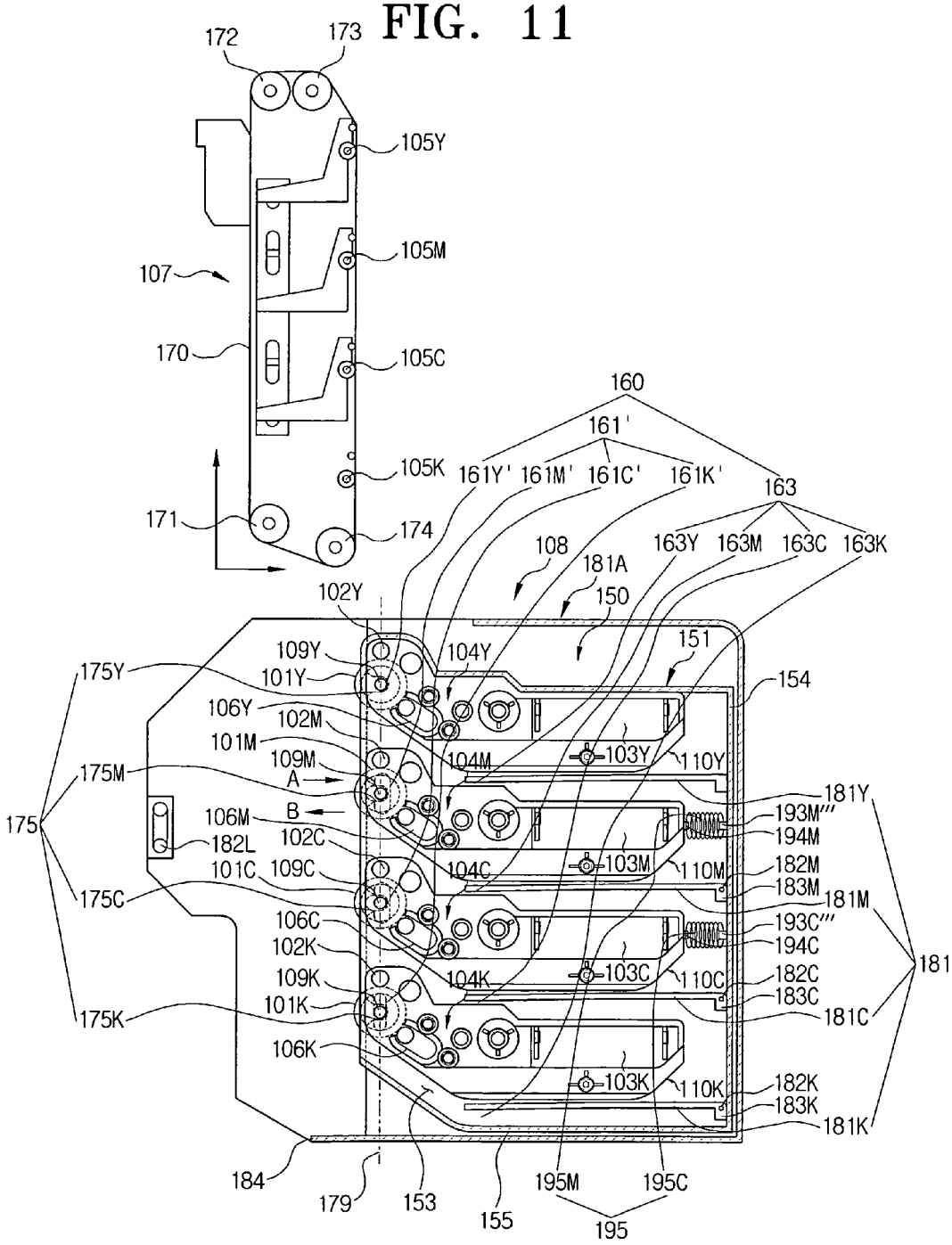
FIG. 11 is an exploded cross sectional view of the mounting frame, the intermediate transfer unit and the image forming cartridge of the image forming device shown in FIG. 6.

As shown in FIG. 11, the supporting part 181 is composed of a fixed support 181Y fixed at an upper portion of a right wall 154 of the cartridge frame 151 to support the first image forming unit 110Y to be unmovable, and first, second and third movable supports 181M, 181C and 181K fixed at the right wall 154 of the cartridge frame 151 to be rotatable through a predetermined angle on first, second and third hinge shafts 182M, 182C and 182K under the fixed support 181Y. The first, the second and the third movable supports 181M, 181C and 181K movably supports the second, third and fourth image forming units 110M, 110C and 110K when the second, the third and the fourth center shafts 109M, 109C and 109K of the second, third and fourth photosensitive bodies 101M, 101C and 101K move.

The first, second and third movable supports 181M, 181C and 181K have first, second, and third stoppers 183M, 183C, 183K (FIG. 11) to restrain them from rotating downwardly through the predetermined angle.

The movable fixing part 160 is comprised of circle-shaped fixed supporting holes 161Y and 161Y' formed at portions of front and rear walls 152 and 153 of the cartridge frame 151 corresponding to both ends of the first center shaft 109Y of the first photosensitive body 101Y of the first image forming unit 110Y at the uppermost position to fix both ends of the first center shaft 109Y to be unmovable, but rotatable. The movable fixing part 160 further comprises motion supporting holes 161, and 161' formed at portions of the front and the rear walls 152 and 153 of the cartridge frame 151 corresponding to both ends of the second, third and fourth center shafts 109M, 109C and 109K of the second, third and fourth photosensitive bodies 101M, 101C and 101K of the second, third and fourth image forming units 110M, 110C and 110K to fix the both ends of the second, third and fourth center shafts 109M, 109C and 109K to be movable and rotatable. The movable fixing part 160 further comprises a movable space 163 having first, second, third and fourth movable gap 163Y, 163M, 163C and 163K formed between the second, third and fourth image forming units 110M, 110C and 110K and the fixed support 181Y and the first and second movable supports 181M and 181C, and between the third support 181K and bottom 155 of cartridge frame 151, such that the second, third and fourth image forming units 110M, 110C and 110K are movable together with a moving of the both ends of the second, third and fourth center shafts 109M, 109C and 109K of the second, third and fourth photosensitive bodies 101M, 101C and 101K thereof.

Preferably, the motion supporting holes 161, and 161' are composed of first and second horizontal-vertical direction sub-holes 161M, 161C, and 161M', 161C' to move both ends of the second and third center shafts 109M and 109C of the second and third photosensitive bodies 101M and 101C of the second and third image forming units 110M and 110C in the direction of both the X and Y axis(horizontal and vertical directions), and vertical direction sub-holes 161K and 161K' to move the both ends of the fourth center shaft 109K of the fourth photosensitive body 101K of the fourth image forming unit 110K in the vertical direction.

By forming the vertical direction sub-holes 161K and 161K' to enable both ends of the fourth center shaft 109K to be only movable in the vertical direction, they can align both ends of the second and third center shafts 109M and 109C of the second and third photosensitive bodies 101M and 101C with a vertical assembling line 179 in cooperation with the fixed supporting holes 161Y and 161Y' when the image forming cartridge 150 is assembled into the mounting frame 108. The vertical assembling line is formed of first, second, third and fourth grooves 175Y, 175M, 175C and 175K of an axis receiving part 175 of the mounting frame 108 to be described in greater detail below.

The first and second horizontal-vertical direction sub-holes 161M, 161C and 161M', 161C' that are more magnified in the horizontal and vertical directions than the fixed supporting holes 161Y and 161Y', are formed in a ¬-shaped form.

Alternatively, the first and second horizontal-vertical direction sub-holes 161M, 161C; and 161M', 161C' can be formed in any other form. For example, they can be a square form, a rectangle form, a circle form, +-shaped form, ⊥-shaped form, or ⊢-shaped form, that can move both ends of the second and the third center shafts 109M and 109C of the second and the third photosensitive bodies 101M and 101C in the horizontal and the vertical directions.

The vertical direction sub-holes 161K and 161K' that are more magnified in the vertical directions than the fixed supporting holes 161Y and 161Y', are formed in a |-shaped form.

The image forming cartridge 150 also further comprises an elastic member 191, 195 elastically pressing the second, third and fourth image forming units 110M, 110C and 110K corresponding to the second, third and fourth center shafts 109M, 109C and 109K of the second, third and fourth photosensitive bodies 101M, 101C and 101K, in the horizontal and vertical directions and the vertical direction to assist a moving of the second, third and fourth image forming units 110M, 110C and 110K in the corresponding directions when it is assembled into the mounting frame 108.

The elastic member 191, 195 is respectively comprised of first, second and third vertical direction extension springs 191M, 191C and 191K (FIG. 12), and first and second horizontal direction extension springs 195M and 195C. The first, second and third vertical direction extension springs 191M, 191C and 191K are disposed between first spring hangers 193M, 193C and 193K formed at one ends of the first, second, and third movable supports 181M, 181C and 181K and second spring hangers 192M, 192C and 192K formed at both or one of the front and the rear walls 152 and 153 of the cartridge frame 151 to pull the second, third and the fourth image forming units 110M, 110C and 110K upwardly in the vertical direction. The first and second horizontal direction extension springs 195M and 195C are supported between fourth and fifth spring hangers 193M''', 193C'''; and 194M, 194C formed respectively at the right wall 154 of the cartridge frame 151 and the second and the third image forming units 110M and 110C therebetween to pull the second and third image forming units 110M and 110C to the right in the horizontal direction.

A pulling force of the first, second and third vertical direction extension springs 191M, 191C and 191K is set such that the second, third and fourth image forming units 110M, 110C and 110K can be maintained in appropriate vertical positions without being in contact with one another. A pulling force of the first and second horizontal direction extension springs 195M and 195C is set such that the second and third image forming units 110M and 110C can be maintained without moving, after both ends of the second and third center shafts 109M and 109C thereof are inserted into the second and third groove 175M and 175C of the shaft receiving part 175.

Figure 9:
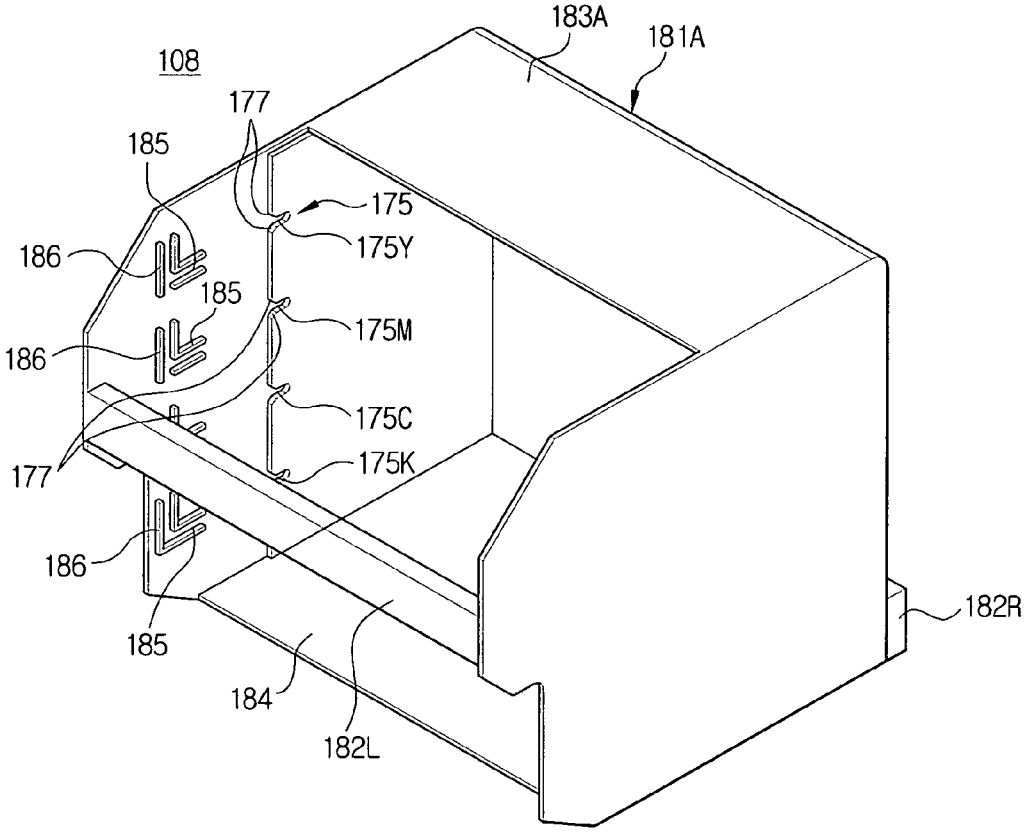
FIG. 9 is a perspective view of the mounting frame of the image forming device shown in FIG. 6.

As shown in FIG. 9, the mounting frame 108 is formed of a rectangular parallel piped-shaped casing 181A constructed to be guided and projected forward by the left and the right supporting rails 182L and 182R in the main body 100A. The mounting frame 108 is formed to install the first, second, third and fourth image forming units 110Y, 110M, 110C and 110K and the intermediate transfer unit 107 therein.

The casing 181A is provided with an upper cover member 183A to cover an upper portion of the image forming cartridge 150, and a lower cover member 184 to guide and protect the image forming cartridge 150 and the intermediate transfer element 170 in mounting and dismounting thereof and at the same time, to act as an upper guide of a paper conveying path.

Vertical grooves 186 and horizontal grooves 185 are formed at inner surfaces of the front and rear walls of the casing 181A to guide positioning pins (not shown) formed at both sides of the intermediate transfer unit 107 to install the intermediate transfer unit 107.

A shaft receiving part 175 is formed at the inner surfaces of front and rear walls of the casing 181A to support the image forming cartridge 150 in mounting thereof at a position corresponding to the both ends of the first, second, third and fourth center shafts 109Y, 109M, 109C and 109K of the first, second, third and fourth photosensitive bodies 101Y, 101M, 101C and 101K to receive and support both ends of the first, second, third and fourth center shafts 109Y, 109M, 109C and 109K.

The shaft receiving part 175 is comprised of first, second, third and fourth grooves 175Y, 175M, 175C and 175K opened on one side of the horizontal direction (i.e., a left side) and formed to receive the first, second, third and fourth center shafts 109Y, 109M, 109C and 109K of the first, second, third and fourth photosensitive bodies 101Y, 101M, 101C and 101K in a spaced-apart relation with one another. At an inlet of each of the first, second, third and fourth grooves 175Y, 175M, 175C and 175K a rounded plane or an inclined plane 177 is formed to easily receive the corresponding first, second, third and fourth center shafts 109Y, 109M, 109C or 109K in inserting thereof.

The first, second, third and fourth grooves 175Y, 175M, 175C and 175K form a vertical assembling reference line 179 (FIG. 11) in the shape of straight line, so that when inserted into the first, second, third and fourth grooves 175Y, 175M, 175C and 175K, the first, second, third and fourth center shafts 109Y, 109M, 109C and 109K can be vertically aligned to cause the first, second, third and fourth photosensitive bodies 101Y, 101M, 101C and 101K to be in contact with the intermediate transfer element 170 of the intermediate transfer unit 107.

As described above, the image forming cartridge 150 in the color image forming device 100 according to the first embodiment of the present invention, in which a portion of the center shafts (i.e. the center shafts 109M, 109C and 109K of the photosensitive bodies 101M, 101C and 101K) are formed to be movable, is assembled into the mounting frame 108 in which the shaft receiving part 175 forms the vertical assembling reference line 179 to align the center shafts 109Y, 109M, 109C and 109K of the photosensitive bodies 101Y, 101M, 101C and 101K, so that the center shafts 109Y, 109M, 109C and 109K can be accurately assembled in position, even though a portion thereof is fabricated so as not to just join with the shaft receiving part 175.

Figure 2:
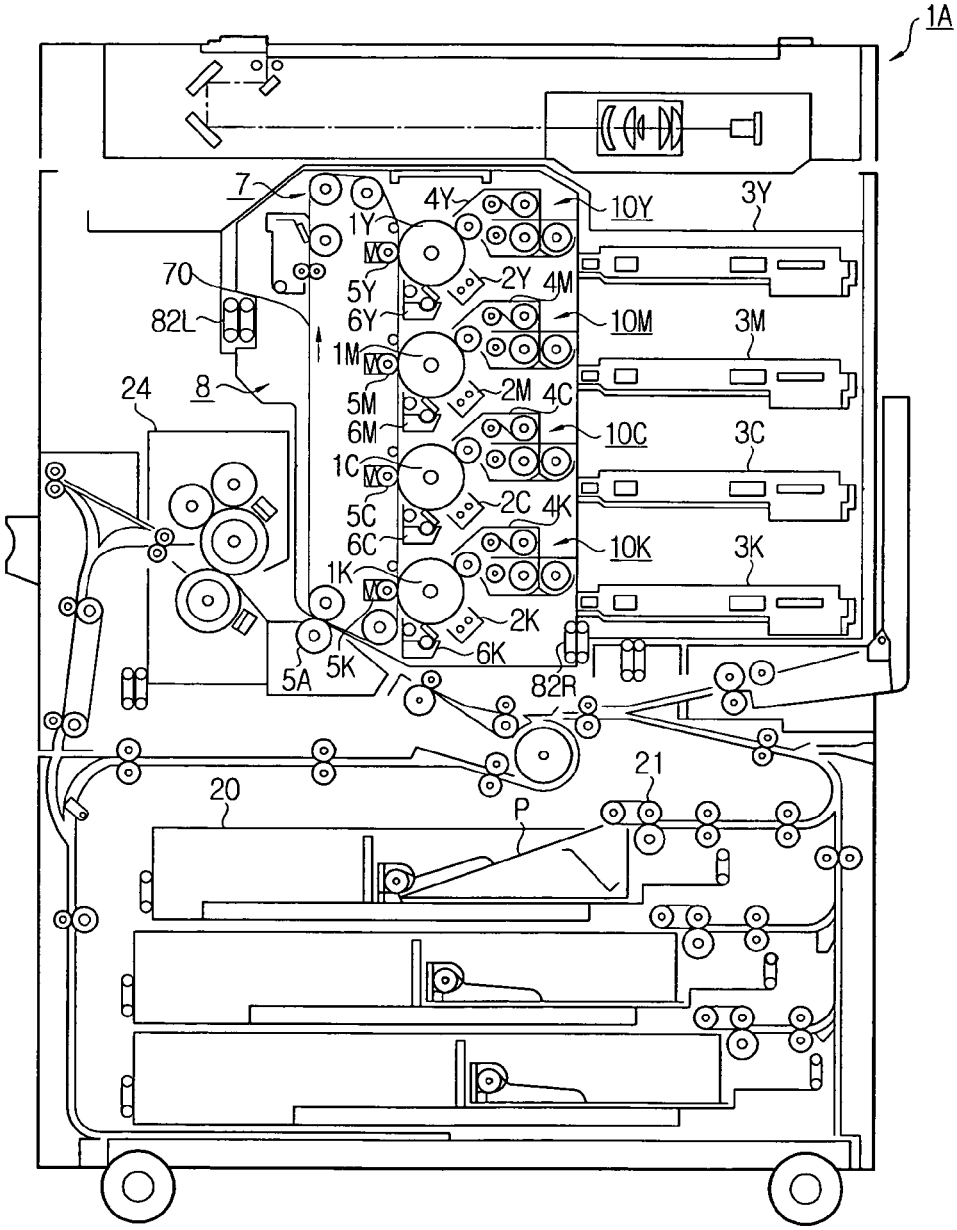
FIG. 2 (PRIOR ART)
FIG. 2 is a cross sectional view of the image forming device shown in FIG. 1.
Figure 3:
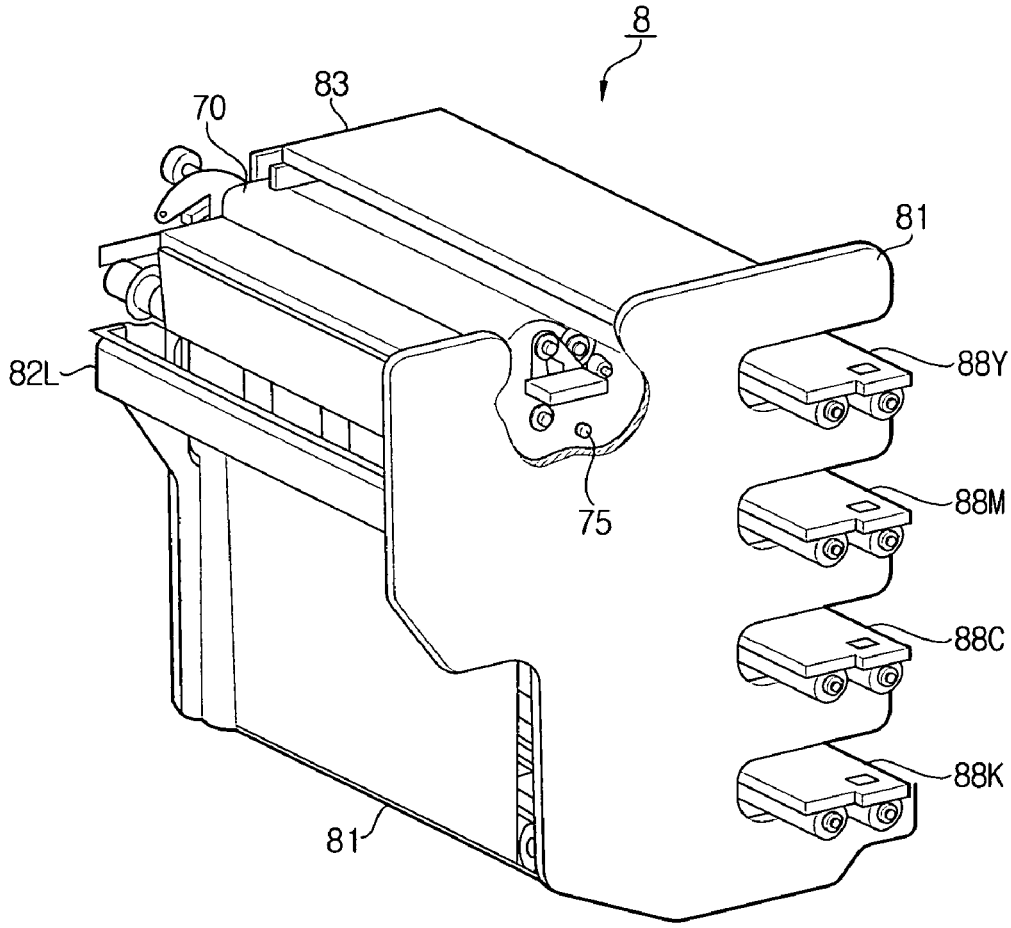
FIG. 3 (PRIOR ART)
FIG. 3 is a perspective view of the mounting frame of the image forming device shown in FIG. 1, having a plurality of image forming units and an intermediate transfer unit mounted therein.
Figure 4:
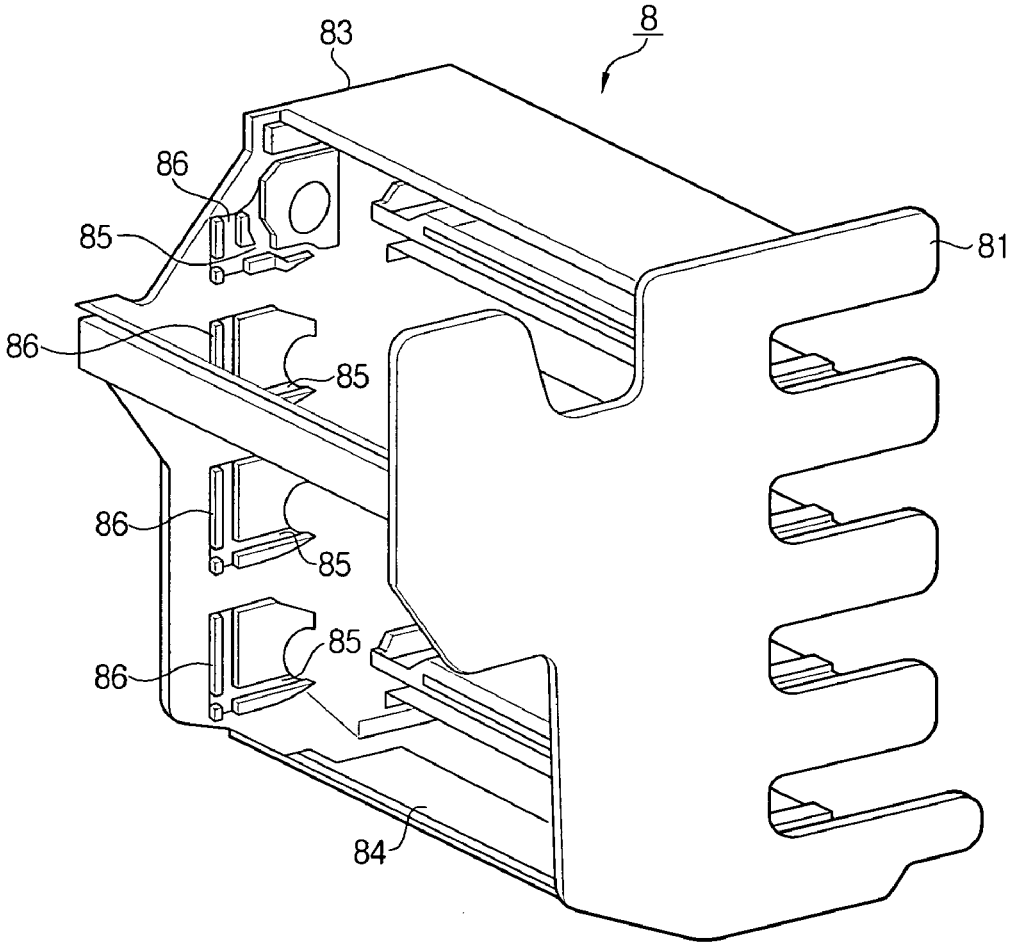
FIG. 4 (PRIOR ART)
FIG. 4 is a perspective view of the mounting frame of the image forming device shown in FIG. 1.
Figure 5:
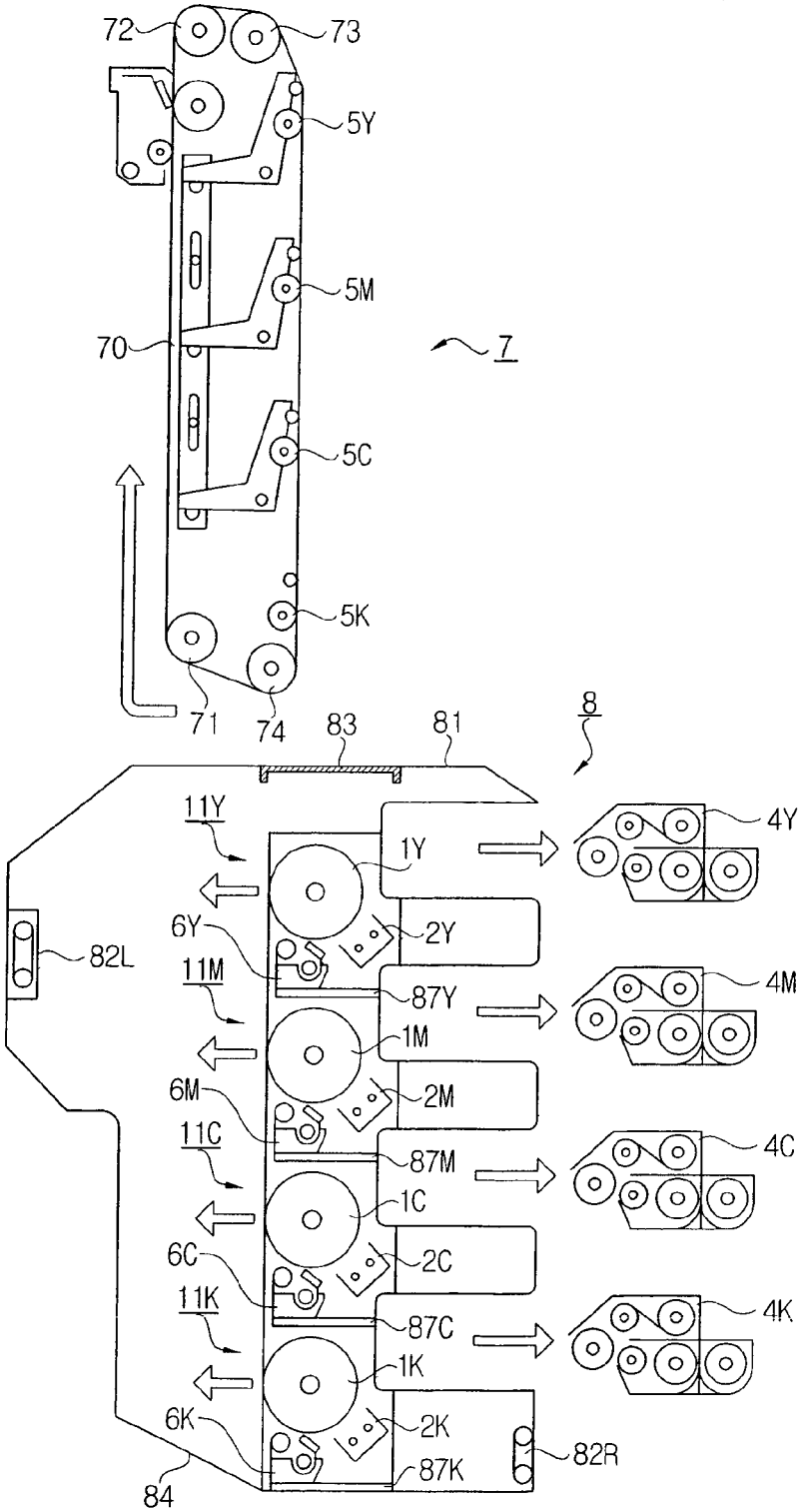
FIG. 5 (PRIOR ART)
FIG. 5 is an exploded cross sectional view of the mounting frame, the intermediate transfer unit and developing units of the image forming device shown in FIG 1.

In the first embodiment of the present invention described above, the color image forming device 100 is illustrated and described as mounting the image forming cartridge 150, in which all components of the image forming units 110Y, 110M, 110C and 110K are modularized in a body, into the mounting frame 108 having the shaft receiving part 175 through the portion of the center shafts(i.e. the center shafts 109M, 109C and 109K of the photosensitive bodies 101M, 101C and 101K formed to be movable). The first embodiment of the present invention is not limited to this particular configuration as one skilled in the art can appreciate, and can also constructed as mounting an image forming cartridge (not shown) in which a portion of components of the image forming units 110Y, 110M, 110C and 110K (e.g., only a photosensitive body assembly (not shown) including the photosensitive bodies 101Y, 101M, 101C and 101K , the charging units 102Y, 102M, 102C and 102K, and the cleaning units 106Y, 106M, 106C and 106K) are modularized into a body, into the mounting frame 108 having the shaft receiving part 175 through the portion of the center shafts (i.e. the center shafts 109M, 109C and 109K of the photosensitive bodies 101M, 101C and 101K formed to be movable). In this case, the rest of the components of the image forming units 110Y, 110M, 110C and 110K—except the photosensitive body assembly—is fixed in the mounting frame 108 in the same way as the conventional image forming device 1 described with reference to FIGS. 1 and 2.

A method for assembling and disassembling the image forming cartridge 150 of the color image forming device 100 according to the first embodiment of the present invention constructed as above will now be described in detail with reference to FIGS. 6 through 13.

To assemble the image forming cartridge 150, as shown in FIG. 6, the mounting frame 108 is installed in the main body 100A and is guided along the left and the right supporting rails 182L and 182R, and ejected forward.

Subsequently, as shown in FIG. 11, the image forming cartridge 150 having the first, second, third and fourth image forming units 110Y, 110M, 110C and 110K (constructed to be modularized in a body) is inserted into the mounting frame 108 from a left and upper side thereof, and then pushed in a direction of arrow A in the mounting frame 108.

The image forming cartridge 150 is then assembled in position in the mounting frame 108 in an appropriate method. The assembling method can further comprise aligning and inserting both ends of the first center shaft 109Y of the first photosensitive body 101Y with and into the first groove 175Y of the shaft receiving part 175, and then sequentially inserting both ends of the second, the third, and fourth center shafts 109M, 109C and 109K of the second, the third and the fourth photosensitive bodies 101M, 101C and 101K into the second, third and fourth grooves 175M, 175C and 175K of the shaft receiving part 175. Alternatively, both ends of the first, second, third, and fourth center shafts 109Y, 109M, 109C and 109K can be simultaneously inserted into the first, second, third and fourth groove 175Y, 175M, 175C and 175K. Here, for purposes of conciseness, it is presumed the image forming cartridge 150 is assembled in position in the mounting frame 108 in accordance with the former method.

Figure 12:
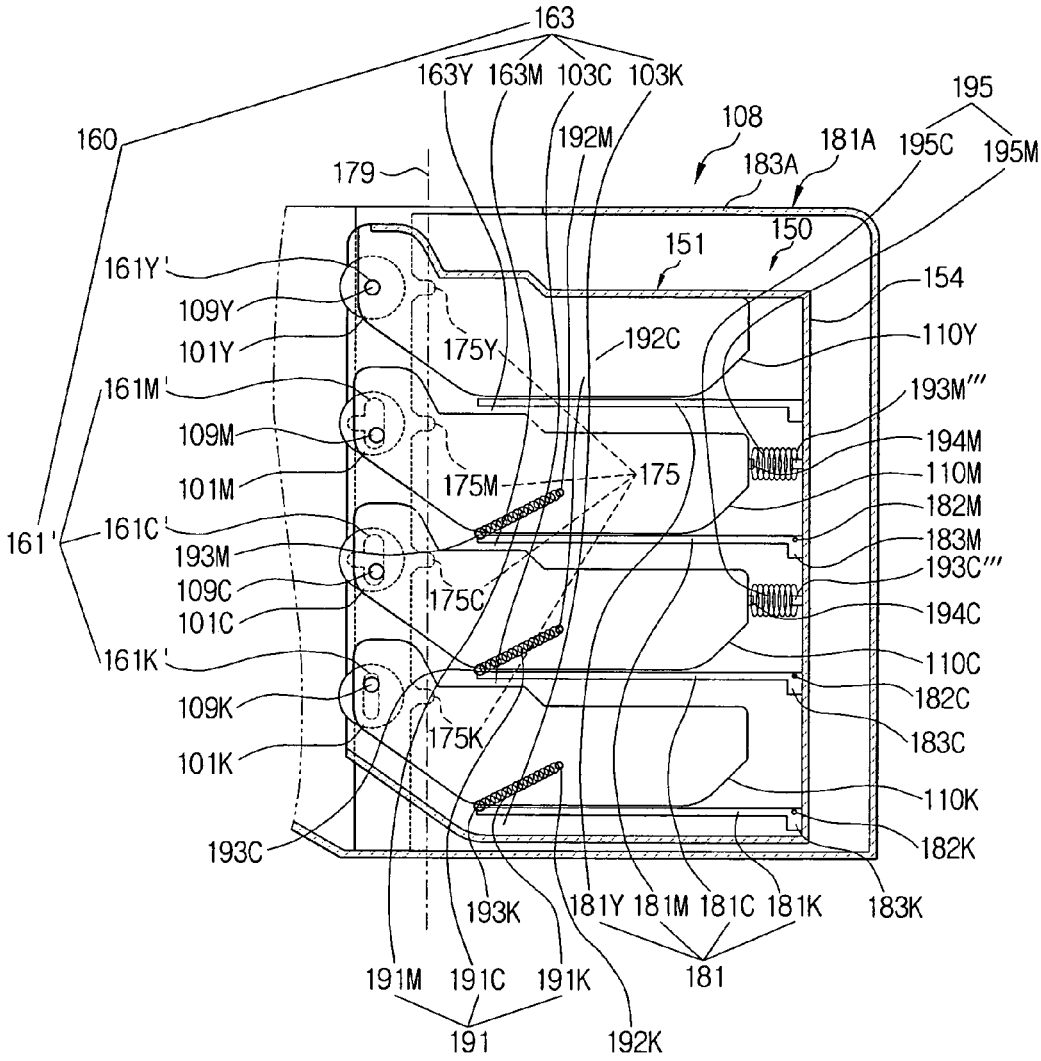
FIGS. 12 and 13 are partial cross sectional views of the image forming device shown in FIG. 6, illustrating an operation of mounting the image forming cartridge in the mounting frame.

As shown in FIG. 12, assuming that the image forming cartridge 150 is fabricated such that both ends of the second and third center shafts 109M and 109C of the second and third photosensitive bodies 101M and 101C are positioned lower than the second and third grooves 175M and 175C, both ends of the fourth center shaft 109K are positioned higher than the fourth groove 175K, and the second and third center shafts 109M and 109C of the second and third photosensitive bodies 101M and 101C are positioned more to the right than a vertical line vertically connecting the first and fourth center shafts 109Y and 109K of the first and the fourth photosensitive bodies 101Y and 101K, after both ends of the first center shaft 109Y of the first photosensitive body 101Y are inserted into the first groove 175Y of the shaft receiving part 175. Both ends of the second and third center shafts 109M and 109C of the second and third photosensitive bodies 101M and 101C are displaced upwardly in the vertical direction in the first and second horizontal-vertical direction sub-holes 161M, 161C and 161M', 161C' along the inclined planes 177 to be inserted into the second and the third grooves 175M and 175C, so that the second and third image forming units 110M and 110C are moved upwardly in the vertical direction against the first and second vertical direction extension springs 191M and 191C.

After inserting both ends of the second and the third center shafts 109M and 109C of the second and third photosensitive bodies 101M and 101C into the second and third grooves 175M and 175C, both ends of the fourth center shaft 109K of the fourth photosensitive body 101K are displaced downwardly in the vertical direction in the vertical direction sub-holes 161K and 161K' along the inclined planes 177 to be inserted into the fourth grooves 175K. By inserting both ends of the second and the third center shafts 109M and 109C of the second and third photosensitive bodies 101M and 101C into the second and third grooves 175M and 175C the fourth image forming unit 110K is moved downwardly in the vertical direction against the third vertical direction extension springs 191K.

When both ends of the fourth center shaft 109K of the fourth photosensitive body 101K are completely seated into the fourth grooves 175K, since the second and third center shafts 109M and 109C of the second and third photosensitive bodies 101M and 101C are positioned more to the right than the vertical line vertically connecting the first and the fourth center shafts 109Y and 109K of the first and fourth photosensitive bodies 101Y and 101K, both ends of the second and third center shafts 109M and 109C are pushed to the left in the horizontal direction along the first and second horizontal-vertical direction sub-holes 161M, 161C and 161M', 161C' by the second and third grooves 175M and 175C to coincide with the vertical assembling reference line 179. After both ends of the fourth center shaft 109K of the fourth photosensitive body 101K are completely seated into the fourth grooves 175K the second and the third image forming unit 110M and 110C is moved to the left in the horizontal direction against the first and the second horizontal direction extension springs 195M and 195C.

Figure 13:
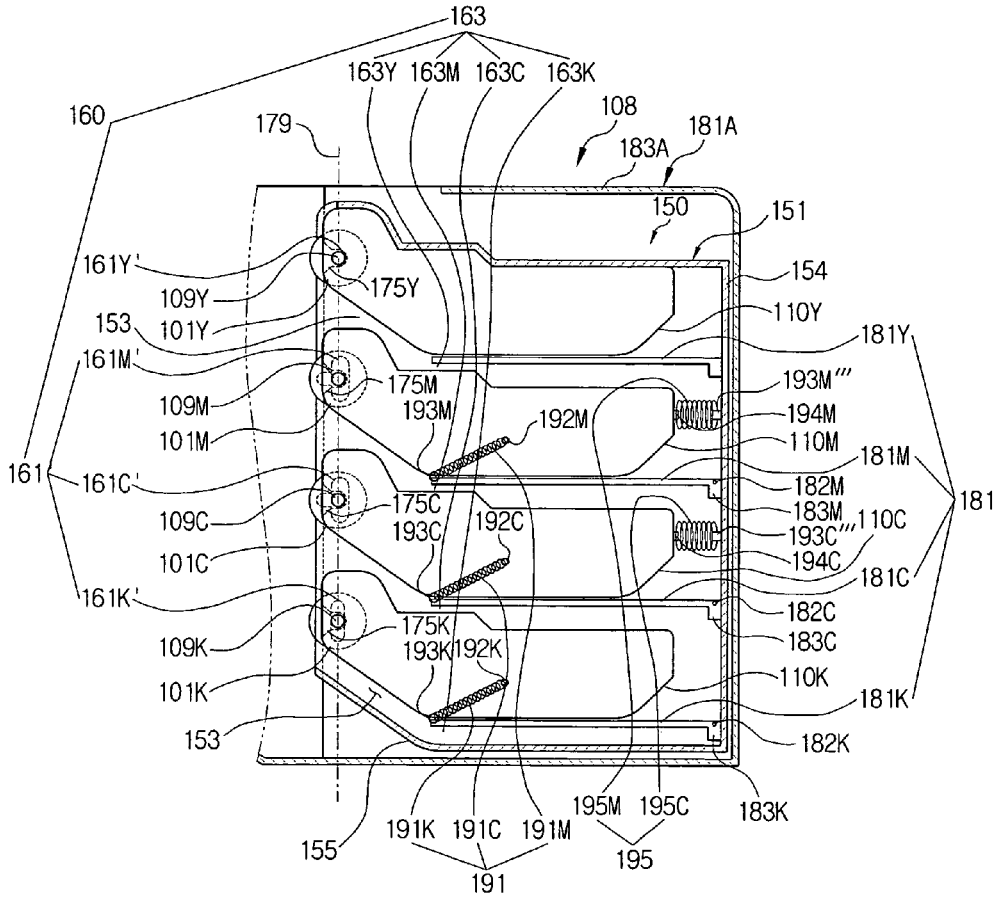

As a result, as shown in FIG. 13, both ends of the first, second, third and fourth center shafts 109Y, 109M, 109C and 109K of the first, second, third and fourth photosensitive bodies 101Y, 101M, 101C and 101K are positioned in the first, second, third and fourth grooves 175Y, 175M, 175C and 175K of the shaft receiving part 175 to accurately coincide with the vertical assembling reference line 179.

As described above, even though both ends of the second, third and fourth center shafts 109M, 109C and 109K of the second, third and fourth photosensitive bodies 101M, 101C and 101K are fabricated so as to not just join with the second, third and fourth grooves 175M, 175C and 175K of the shaft receiving part 175, they are accurately assembled into position in the second, third and fourth grooves 175M, 175C and 175K. Both ends of the second, third and fourth center shafts 109M, 109C and 109K move in the vertical and horizontal directions, or the vertical direction along the inclined planes 177 of the second, third and fourth grooves 175M, 175C and 175K.

After assembling the image forming cartridge 150 in the mounting frame 108 as shown in FIG. 11, the intermediate transfer unit 107 is lowered into the mounting frame 108 from the left and upper side thereof, and then moved a little to the right and mounted in the mounting frame 108.

To guide the intermediate transfer unit 107, the positioning pins of the intermediate transfer unit 107 are moved downwardly in the vertical direction along the vertical grooves 186 of the mounting frame 108, and then moved to the right along the horizontal grooves 185.

With a mounting of the intermediate transfer unit 107 into the mounting frame 108 as described above, the first, second, third and fourth photosensitive bodies 101Y, 101M, 101C and 101K become to be in contact with a transfer surface of the intermediate transfer element 170.

Following the mounting of the intermediate transfer unit 107 into the mounting frame 108, the mounting frame 108, having the image forming cartridge 150 and the intermediate transfer unit 107 mounted therein, is again pushed into the main body 100A along the left and the right supporting rails 182L and 182R, and assembling of the image forming cartridge 150 is completed.

The method for disassembling the image forming cartridge 150 from the mounting frame 108 to maintain and repair the image forming cartridge 150 is performed in the opposite order of assembling the image forming cartridge 150 as described above.

Embodiment 2

Figure 14:
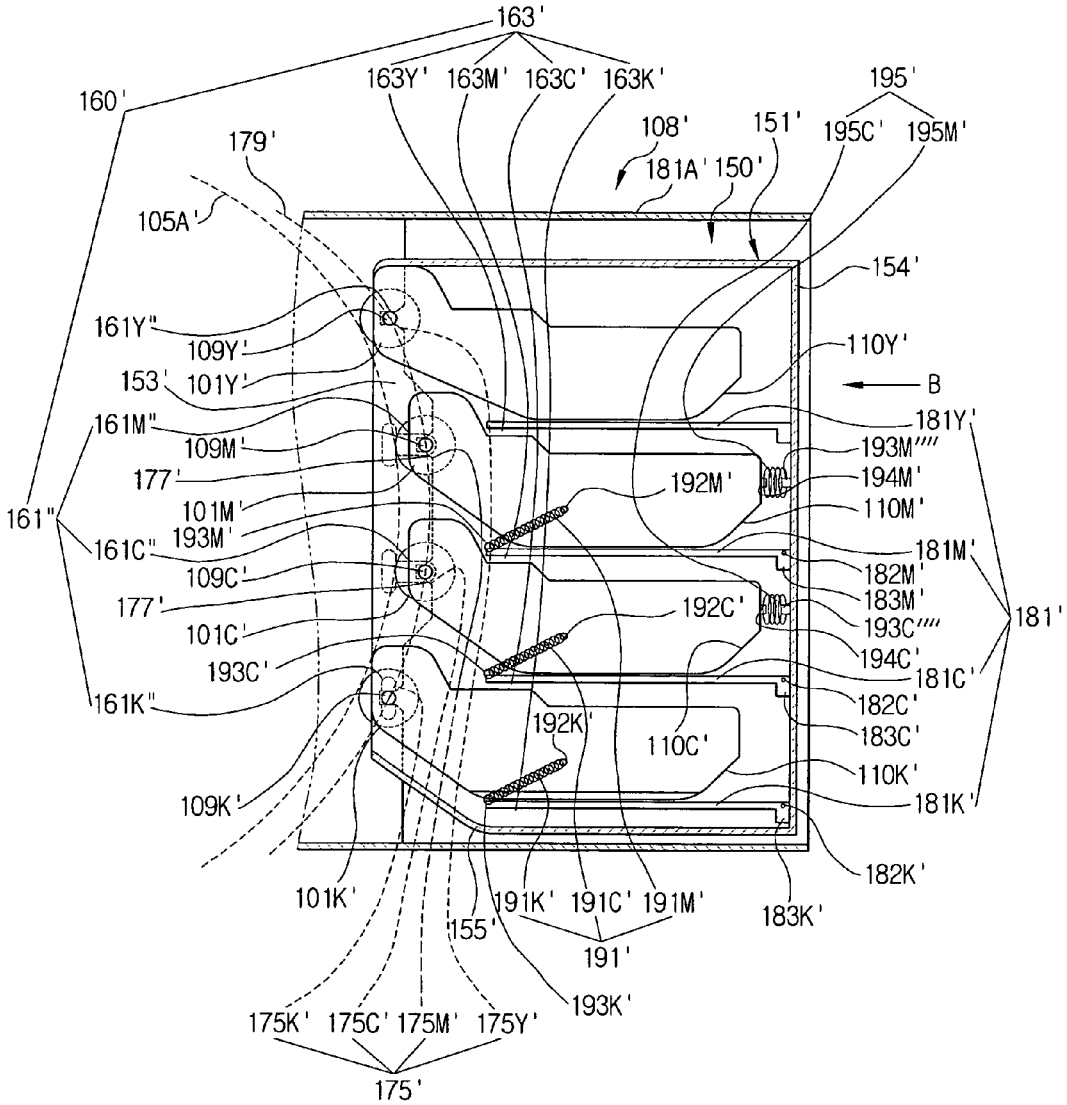
FIG. 14 is a partial cross sectional view of a color image forming device in accordance with a second preferred embodiment of the present invention, illustrating a state of an image forming cartridge assembled in a mounting frame.

FIG. 14 illustrates a mounting frame 108' and an image forming cartridge 150' of a tandem color image forming device according to a second embodiment of the present invention.

Unlike the color image forming device 100 of the first embodiment described with reference to FIGS. 6 through 13, the tandem color image forming device of the second embodiment is constructed to transfer toner images formed on photosensitive bodies 110Y', 101M', 101C', and 101K' directly onto a sheet of printing paper through a transfer unit 105A' such as a transfer drum, without using an intermediate transfer unit that receives the toner images formed on the photosensitive bodies 101Y', 101M', 101C', and 101K' and then retransfers them onto the sheet of printing paper.

The tandem color image forming device of the second embodiment comprises a paper feeding unit (not shown) to feed sheets of printing paper contained in a paper cassette (not shown), an image forming cartridge 150' having first, second, third and fourth image forming units 110Y', 110M', 110C' and 110K' for forming toner images of four colors (i.e., yellow, magenta, cyan, and black) disposed vertically in parallel to be modularized in a body, and a transfer unit 105A', such as a transfer drum, rotatably supported at a left side of first, second, third and fourth drum-shaped photosensitive bodies 101Y', 101M', 101C', and 101K' disposed respectively in the first, second, third and fourth image forming units 110Y', 110M', 110C' and 110K', and transferring toner images formed on the first, the second, the third and the fourth photosensitive bodies 101Y', 101M', 101C', and 101K' onto a sheet of printing paper. The tandem color image forming device of the second embodiment further comprises a mounting frame 108' disposed at a main body (not shown) and installing the image forming cartridge 150' therein; and a fusing unit (not shown) to fuse and fix the toner images transferred onto the sheet of printing paper with a heat and pressure.

A description regarding the paper feeding unit and the fusing unit among these components will be omitted, as it is identical to that of the color image forming device 100 of the first embodiment that as described above with reference to FIGS. 6 through 13.

The mounting frame 108' includes a shaft receiving part 175' formed at inner surfaces of front and rear walls of the casing 181A'. The shaft receiving part 175' is comprised of first, second, third and fourth grooves 175Y', 175M', 175C'and 175K' opened in the other side of the horizontal direction, i.e., a right side. The first, second, third and fourth grooves 175Y', 175M', 175C' and 175K' form an arc-shaped assembling reference line 179' that aligns first, second, third and fourth center shafts 109Y', 109M', 109C' and 109K' of the first, second, third and fourth photosensitive bodies 101Y', 101M', 101C' and 101K' in the shape of arc. Accordingly, when the first, second, third and fourth center shafts 109Y', 109M', 109C' and 109K' are inserted into the first, second, third and fourth grooves 175Y', 175M', 175C' and 175K', the first, second, third and fourth photosensitive bodies 101Y', 101M', 101C' and 101K' become in contact with a circumference surface of the transfer unit 105A'.

The image forming cartridge 150' is further provided with a rectangular parallel piped-shaped cartridge frame 151', a movable fixing part 160' supporting the second, third and fourth center shafts 109M', 109C' and 109K' of the second, the third and fourth photosensitive bodies 101M', 101C' and 101K' to be movable and rotatable, and an elastic member 191', 195' elastically pressing the second, third and fourth image forming units 110M', 110C' and 110K' in the horizontal and the vertical directions.

The cartridge frame 151' has a supporting part 181'. The supporting part 181' is composed of a fixed support 181Y' to support the first image forming unit 110Y' to be unmovable, and first, second and third movable supports 181M', 181C' and 181K' to support the second, third and fourth image forming units 110M', 110C' and 110K'to be movable. The first, second and third movable supports 181M', 181C' and 181K' are fixed at the right wall 154' of the cartridge frame 151' to be rotatable through a predetermined angle on first, second and third hinge shafts 182M', 182C' and 182K' under the fixed support 181Y'. The second, third and fourth image forming units 110M', 110C' and 110K' are moved by a displacement of the first, second and third center shafts 109M', 109C' and 109K' of the second, third and fourth photosensitive bodies 101M, 101C and 101K when inserting thereof into the first, second, third and fourth grooves 175Y', 175M', 175C' and 175K' of the shaft receiving part 175'.

The first, second and third movable supports 181M', 181C' and 181K' have first, second, and third stoppers 183M', 183C', 183K' (FIG. 14) to restrain them from rotating downwardly through the predetermined angle.

The movable fixing part 160' is provided with fixed supporting holes 161Y" (one shown), motion supporting holes 161" (one shown), and a movable space 163'. The fixed supporting holes 161Y" are formed at portions of the front and rear walls 153' (only a rear wall shown) of the cartridge frame 151' corresponding to both ends of the first center shaft 109Y' of the first photosensitive body 101Y' to support both ends of the first center shaft 109Y' to be rotatable. The motion supporting holes 161" are composed of first and second ⊢-shaped horizontal-vertical direction sub-holes 161M", 161C" formed at portions of the front and rear walls 153' of the cartridge frame 151' corresponding to both ends of the second and third center shafts 109M' and 109C' of the second and third photosensitive body 101M' and 101C' to support and move both ends of the second and third center shafts 109M' and 109C'. The second and third center shafts 109M' and 109C' will then be rotatable and movable in both the horizontal and vertical directions In addition, I-shaped vertical direction sub-holes 161K" are formed at portions of the front and rear walls 153' of the cartridge frame 151' corresponding to both ends of the fourth center shaft 109K' of the fourth photosensitive body 101K' to support both ends of the fourth center shaft 109K' to be rotatable and movable in the vertical direction. The movable space 163' is composed of the first, second, third and fourth movable gaps 163Y', 163M', 163C' and 163K' formed between the second, third and fourth image forming units 110M', 110C' and 110K' and the fixed support 181Y' and the first and the second movable supports 181M' and 181C', and between the third movable support 181K' and bottom 155' of the cartridge frame 151', such that the second, third and fourth photosensitive bodies 101M', 101C' and 101K' are movable together with a displacement of both ends of the second, third and fourth center shafts 109M', 109C' and 109K' thereof.

The elastic member 191', 195' is comprised of first, second and third vertical direction extension springs 191M', 191C' and 191K', and first and second horizontal direction compression springs 195M' and 195C'. The first, second and third vertical direction extension springs 191M', 191C' and 191K' are installed between first spring hangers 193M', 193C' and 193K' formed at one end of the first, second, and third movable supports 181M', 181C' and 181K' and second spring hangers 192M', 192C' and 192K' formed at both or one of the front and the rear walls 153' of the cartridge frame 151' to pull the second, third and fourth image forming units 110M', 110C' and 110K' upwardly in the vertical direction. The first and second horizontal direction compression springs 195M' and 195C' are disposed between the first and second spring seats 193M"", 193C"", 194M', 194C' and formed respectively at the right wall 154' of the cartridge frame 150' and the second and third image forming units 110M' and 110C' to push the second and third image forming units 110M' and 110C' to the left in the horizontal direction.

The color image forming device of the second embodiment of the present invention further comprises a locking part (not shown) to prevent the image forming cartridge 150' from being separated from the mounting frame 108' by the first and second horizontal direction compression springs 195M' and 195C' after the image forming cartridge 150' is assembled in the mounting frame 108'. The locking part can be composed of a hook (not shown) and a hook receiving opening (not shown) formed at the image forming cartridge 150' and the mounting frame 108', respectively.

A method for assembling and disassembling the image forming cartridge 150' of the color image forming device according to the second embodiment of the present invention constructed as above will now be explained in detail with reference to FIG. 14.

To assemble the image forming cartridge 150', the image forming cartridge 150' having the first, second, third and fourth image forming units 110Y,' 110M', 110C' and 110K' constructed to be modularized in a body is inserted into the mounting frame 108' of the main body from a right side thereof, and then pushed in a direction of arrow B in the mounting frame 108'.

The image forming cartridge 150' is then assembled in position in the mounting frame 108' by, for example, aligning and inserting both ends of the first center shaft 109Y' of the first photosensitive body 101Y' with and into the first groove 175Y' of the shaft receiving part 175' and then sequentially inserting both ends of the second, third, and fourth center shafts 109M', 109C' and 109K' of the second, third and fourth photosensitive bodies 101M', 101C' and 101K' into the second, third and fourth grooves 175M', 175C' and 175K' of the shaft receiving part 175'. Alternatively, the image forming cartridge 150' can be assembled in position in the mounting frame 108' by simultaneously inserting both ends of the first, second, third, and fourth center shafts 109Y', 109M', 109C' and 109K' into the first, second, third and fourth groove 175Y', 175M', 175C' and 175K'. Here, conciseness, it is presumed that the assembling of the image forming cartridge 150' in position in the mounting frame 108' is performed by the latter method.

As the image forming cartridge 150' is pushed and inserted into the mounting frame 108' toward the direction of arrow B, both ends of the second and third center shafts 109M' and 109C' of the second and third photosensitive bodies 101M' and 101C' are first guided along the inclined planes 177' of the shaft receiving part 175', and move in the horizontal and vertical directions in the first and second horizontal-vertical direction sub-holes 161M" and 161C". Both ends of the second and third center shafts 109M' and 109C' of the second and third photosensitive bodies 101M' and 101C' are then inserted into the second and the third grooves 175M' and 175C'.

As a result, the second and the third photosensitive bodies 101M' and 101C' first come in contact with the circumference surface of the transfer unit 105A'.

Subsequently, as the image forming cartridge 150' further moves in the direction of arrow B, the second and third image forming units 110M' and 110C' having both ends of the second and third center shafts 109M' and 109C' inserted in the second and third grooves 175M' and 175C' is pushed backward (i.e. to the right against the first and second compression springs 195M' and 195C') and at the same time both ends of the first and fourth center shafts 109Y' and 109K' are inserted along the inclined planes 177' of the shaft receiving part 175' into the first and fourth grooves 175Y' and 175K'. As a result, the first and fourth photosensitive bodies 101Y' and 101K' come in contact with the circumference surface of the transfer unit 105A'.

Following contact with the circumference surface of the transfer unit 105A' by the first and fourth photosensitive bodies 101Y' and 101K' both ends of the first and fourth center shafts 109Y' and 109K' are completely seated in the first and fourth grooves 175Y' and 175K', the first, second, third and fourth center shafts 109Y', 109M', 109C' and 109K' of the first, second, third and fourth photosensitive bodies 101Y', 101M', 101C' and 101K' are positioned to coincide with the arc-shaped assembling reference line 179' formed by the first, second, third and fourth grooves 175Y', 175M', 175C' and 175K' of the shaft receiving part 175'.

As described above, even though both ends of the second, third and fourth center shafts 109M', 109C' and 109K' of the second, third and fourth photosensitive bodies 101M', 101C' and 101K' are fabricated so as to not just join with the second, third and fourth grooves 175M', 175C' and 175K' of the shaft receiving part 175', they are accurately assembled in position in the second, third and fourth grooves 175M', 175C' and 175K', move in both the vertical and horizontal directions along the inclined planes 177' of the second, the third and fourth grooves 175M', 175C' and 175K'.

To prevent the image forming cartridge 150' from being separated from the mounting frame 108' after assembling, the image forming cartridge 150' is locked to the mounting frame 108' by the locking part such as the hook and the hook receiving opening formed respectively at the image forming cartridge 150' and the mounting frame 108', and assembling of the image forming cartridge 150' is completed.

The method for disassembling the image forming cartridge 150' from the mounting frame 108' for maintenance and repair of the image forming cartridge 150' is performed in the opposite order of assembling the image forming cartridge 150' as described above.

Embodiment 3

FIG. 15 illustrates an image forming cartridge 150" and a mounting frame 108" of a tandem color image forming device according to a third embodiment of the present invention.

The tandem color image forming device of the third embodiment comprises a paper feeding unit (not shown), an image forming cartridge 150", an intermediate transfer unit (not shown), a mounting frame 108", a transfer unit (not shown), and a fusing unit (not shown).

The description regarding the paper feeding unit, the intermediate transfer unit, the mounting frame 108", the transfer unit, and the fusing unit except for the image forming cartridge 150" will be omitted here, as it is identical to that of the ones of the tandem color image forming device 100 of the first embodiment that are described above with reference to FIGS. 6 through 13.

The image forming cartridge 150" includes a cartridge frame 151" having first, second, third and fourth image forming units 110Y", 110M", 110C" and 110K" disposed longitudinally in parallel therein to modularize in a body.

The cartridge frame 151" is formed of a rectangular parallel piped-shaped casing 155" having a supporting part 181", which is disposed in a frame casing 181A" of the mounting frame 108". The frame casing 181A" includes a cover member 183A" having a right wall 154" to cover the image forming cartridge 150". The supporting part 181" is composed of first, second, and third partition walls 181Y", 181M" and 181C" forming four compartments to receive the first, second, third and fourth image forming units 110Y", 110M", 110C" and 110K".

The first, second, third and fourth image forming units 110Y", 110M", 110C" and 110K" contained in the cartridge frame 151" are respectively provided with first, second, third and fourth photosensitive bodies 101Y", 101M", 101C" and 101K", first, second, third and fourth charging units 102Y", 102M", 102C" and 102K", first, second, third and fourth cleaning units 106Y", 106M", 106C" and 106K", first, second, third and fourth laser scanning units 103Y", 103M", 103C" and 103K", and first, second, third and fourth developing units 104Y", 104M", 104C" and 104K", which are formed in a proximity of circumferences of the first, second, third and fourth photosensitive bodies 101Y", 101M", 101C" and 101K".

The first, second, third and fourth center shafts 109Y", 109M", 109C" and 109K" of the first, second, third and fourth photosensitive bodies 101Y", 101M", 101C" and 101K" are fixed, or movably supported by a movable fixing part 160". The second, third and fourth center shafts 109M", 109C" and 109K" of the second, third and fourth photosensitive bodies 101M", 101C" and 101K" are assembled in the second, third, and fourth grooves 175M", 175C", and 175K" of shaft receiving part 175". The second, third, and fourth grooves 175M", 175C", and 175K" of shaft receiving part 175" form a vertical assembling line 179".

The movable fixing part 160" is provided with fixed supporting holes 161Y'" (one shown), and motion supporting holes 161'" (one shown). The fixed supporting holes 161Y'" are formed in a shape of circle at the front and rear walls of first frame 111Y of the first image forming unit 110Y" to support both ends of the first center shaft 109Y" of the first photosensitive body 101Y" of the first image forming unit 110Y" to be unmovable, but rotatable. The motion supporting holes 161'" are composed of first and second horizontal-vertical direction sub-holes 161M'" and 161C'" formed at the front and rear walls of second and third frames 111M and 111C of the second and third image forming units 110M" and 110C" to support both ends of the second and third center shafts 109M" and 109C" of the second and third photosensitive bodies 101M" and 101C" of the second and third image forming units 110M" and 110C" to be rotatable and movable in both the horizontal and vertical directions. Vertical direction sub-holes 161K'" are formed at both the front and rear walls of fourth frame 111K of the fourth image forming unit 110K" to support both ends of the fourth center shaft 109K" of the fourth photosensitive bodies 101K" of the fourth image forming unit 110K" to be rotatable and movable in the vertical direction.

The first and second horizontal-vertical direction sub-holes 161M'" and 161C'" are formed in a ¬-shaped form to be more magnified in the horizontal and the vertical directions than the fixed supporting holes 161Y'", so that both ends of the second and third center shafts 109M" and 109C" of the second and third photosensitive bodies 101M" and 101C" of the second and third image forming units 110M" and 110C" can be movable or displaceable in both the horizontal and vertical directions. Alternatively, the vertical direction sub-holes 161K'" are formed in a ⊢-shaped form to be more magnified in the vertical direction than the fixed supporting holes 161Y'", so that both ends of the fourth center shafts 109K" of the fourth photosensitive bodies 101K" of the fourth image forming units 110K" can be movable in the vertical direction.

The size of the first and second horizontal-vertical direction sub-holes 161M'" and 161C'" and the vertical direction sub-holes 161K'" that is larger than the fixed supporting holes 161Y'" (i.e., a moving range of the second, the third and the fourth center shafts 109M", 109C" and 109K") is illustrated in FIG. 15 for comparative purposes only, and not meant to illustrate the true size of the sub-holes. Each of both ends of the second, the third and the fourth center shafts 109M", 109C" and 109K" can be displaced within a total range of or about 1 mm for each of the horizontal and the vertical directions. The reason is that since when the second, third and fourth center shafts 109M", 109C" and 109K" of the second, third and fourth photosensitive bodies 101M", 101C" and 101K" are assembled in the second, third, and fourth grooves 175M", 175C", and 175K" of shaft receiving part 175", the holes of the second, third and fourth image forming units 110M", 110C" and 110K" do not move together with the second, third and fourth center shafts 109M", 109C" and 109K". This results because the second, third and fourth photosensitive bodies 101M", 101C" and 101K" can be assembled out of tolerance(i.e., the permitted working limit with surrounding devices such as the charging units 102M", 102C" and 102K", the cleaning units 106M", 106C" and 106K", the laser scanning units 103M", 103C" and 103K", and the developing units 104M", 104C" and 104K"). If the second, third and fourth center shafts 109M", 109C" and 109K" thereof are fabricated to be excessively displaceable, this out-of-tolerance situation becomes present. In this case, a stable image quality cannot be obtained.

The cartridge frame 151" can further include holes (not shown) formed portions of at front and rear walls 153" (only a rear wall shown) in a form corresponding to the motion supporting holes 161'" formed at the second, third and fourth frames 111Y, 111M, 111C and 111K of the second, third and fourth image forming units 110Y", 119M", 110C" and 11OK", so that the second, third and fourth center shafts 109M", 109C" and 109K" can easily move with respect to the motion supporting holes 161'".

Alternatively, the cartridge frame 151" can be constructed to have a supporting part (not shown) composed of a plurality of partition walls (not shown) constituting a plurality of, for example four compartments (not shown), each receiving components to form one image forming unit. The number of compartments, as one skilled in the art can appreciate, can vary, and is the aforementioned example is not meant to be a limiting feature of the description of the embodiments of the present invention.

In this case, a movable fixing part (not shown) is provided with fixed supporting holes (not shown) formed at portions of the front and rear walls (not shown) of a cartridge frame (not shown) corresponding to a first compartment (not shown) receiving components of the first image forming unit (not shown), and motion supporting holes (not shown) having first and second ¬-shaped horizontal-vertical direction sub-holes (not shown) formed at portions of the front and the rear walls of the cartridge frame corresponding to second and third compartments (not shown) receiving components of second and third image forming units (not shown). The movable fixing part is further provided with |-shaped vertical direction sub-holes (not shown) formed at portions of the front and the rear walls of the cartridge frame corresponding to a fourth compartment (not shown) receiving components of the fourth image forming unit (not shown).

The description regarding the method for assembling and disassembling the image forming cartridge 150" of the color image forming device according to the third embodiment of the present invention, as constructed above, will be omitted here, as it is identical to that of the tandem image forming device 100 of the first embodiment that is described above with reference to FIGS. 6 through 13, except that when the first, second, third and fourth center shafts 109Y", 109M", 109C" and 109K" of the first, second, third and fourth photosensitive bodies 101Y", 101M", 101C" and 101K" are assembled in and disassembled from the first, second, third, and fourth grooves 175Y", 175M", 175C", and 175K" of the shaft receiving part 175", the second, third and fourth image forming units 110M", 110C" and 11OK" are not moved, but only the second, third and fourth center shafts 109M", 109C" and 109K" of the second, third and fourth photosensitive bodies 101M", 101C" and 101K" are displaced.

Embodiment 4

FIG. 16 illustrates an image forming cartridge 150'" and a mounting frame 108'" of a tandem color image forming device according to a fourth embodiment of the present invention.

The tandem color image forming device of the fourth embodiment comprises a paper feeding unit (not shown), an image forming cartridge 150'", an intermediate transfer unit (not shown), a mounting frame 108'", a transfer unit (not shown), and a fusing unit (not shown).

The description about the paper feeding unit, the intermediate transfer unit, the mounting frame 108'", the transfer unit, and the fusing unit except for the image forming cartridge 150'" among these components will be omitted here, as it is identical to that of the ones of the tandem color image forming device of the second embodiment that are described above with reference to FIG. 14.

As shown in FIG. 16, the image forming cartridge 150'" comprises a cartridge frame 151'", and a movable fixing part 160'". The cartridge frame 151'" is formed of a rectangular parallel piped-shaped casing 155'" having a supporting part 181'" and a right wall 154'", which is disposed in a frame casing 181A'" of the mounting frame 108'". The supporting part 181'" is composed of first, second, and third partition walls 181Y'", 181M'" and 181C'" forming four compartments, each receiving one of first, second, third and fourth image forming units 110Y'", 110M'", 110C'" and 110K'".

The movable fixing part 160'" is provided with fixed supporting holes 161Y"" (one shown) to support both ends of first center shaft 109Y'" of first photosensitive body 101Y" of the first image forming unit 110Y'" to be rotatable, and motion supporting holes 161"" (one shown) composed of first and second ⊢-shaped horizontal-vertical direction sub-holes 161M"" and 161C"", and |-shaped vertical direction sub-holes 161K"". The first and second horizontal-vertical direction sub-holes 161M"" and 161C"" support both ends of second and third center shafts 109M'" and 109C'" of the second and third photosensitive bodies 101M'" and 101C'" of the second and third image forming units 110M'" and 110C'" to be rotatable and movable in both the horizontal and vertical directions, whereas the vertical direction sub-holes 161K"" support both ends of fourth center shaft 109K'" of fourth photosensitive bodies 101K'" of the fourth image forming unit 110K'" to be rotatable and movable in the vertical direction.

The fixed supporting holes 161Y"" are formed at the front and rear walls of the first frame 111Y' of the first image forming unit 110Y'" to rotatably fix the first center shaft 109Y'" of the first photosensitive body 101Y'" in the first image forming unit 110Y'". Further, the first and second horizontal-vertical direction sub-holes 161M"" and 161C"" are formed at the front and rear walls of the second and third frame 111M' and 111C' of the second and third image forming unit 110M'" and 110C'" to support the second and third center shafts 109M'" and 109C'" of the second and third photosensitive bodies 101M'" and 101C'" of the second and third image forming units 110M'" and 110C'" to be rotatable and movable in both the horizontal and vertical directions. The vertical direction sub-holes 161K"" are formed at the front and rear walls of the fourth frame 111K' of the fourth image forming unit 110K'" to support the fourth center shafts 109K'" of the fourth photosensitive bodies 101K'" of the fourth image forming units 110K'" to be rotatable and movable in the vertical direction.

In regard to the scale shown in FIG. 16 of the first and second horizontal-vertical direction sub-holes 161M"" and 161C"" and the vertical direction sub-holes 161K"", it is apparent that these holes are shown to be larger than the fixed supporting holes 161Y"" (i.e., the movable range of the second, the third and the fourth center shafts 109M'", 109C'" and 109K'") for purposes of this discussion alone. Each of both ends of the second, third and fourth center shafts 109M'", 109C'" and 109K'" can moved or displaced within a total range of or about 1 mm for each of the horizontal and the vertical directions to prevent the second, third and fourth photosensitive bodies 101M'" and 101C'" and 110K'" from being assembled out of an assembling tolerance with surrounding devices such as charging units (not shown), cleaning units (not shown), laser scanning units (not shown), and the developing (not shown) in the second, third and fourth image forming units 110M''', 110C''' and 110K'''.

The cartridge frame 151''' can further include holes (not shown) formed at portions of front and rear walls 153'' (only rear wall shown) in a form corresponding to the motion supporting holes 161'''' formed at the second, third and fourth frames 111M', 111C' and 111K' of the second, third and fourth image forming units 110M''', 110C''' and 110K'''. As a result, the second, third and fourth center shafts 109M''', 109C''' and 109K''' can easily move with respect to the motion supporting holes 161''''.

Furthermore, the position of the fixed supporting holes 161Y'''', the first and second horizontal-vertical direction sub-holes 161M'''' and 161C'''', the vertical direction sub-holes 161K'''' of the motion supporting holes 161'''', and the position of the first, second, third and fourth center shafts 109Y''', 109M''', 109C''' and 109K''' disposed therein are arranged with first, second, third and fourth grooves 175Y''', 175M''', 175C''' and 175K''' of the shaft receiving part 175'' formed in inner surface of front and rear walls of the mounting frame 108'''. The first, second, third and fourth groove 175Y''', 175M''', 175C''' and 175K''' form an arc-shaped assembling reference line 179''' for aligning the first, second, third and fourth center shafts 109Y''', 109M''', 109C''' and 109K''' in a shape of arc so that the first, second, third and fourth photosensitive bodies 101Y''', 101M''', 101C''', and 101L''' come in contact with the circumferential surface of the transfer unit 105A''.

The method for assembling and disassembling the image forming cartridge 150''' of the color image forming device according to the fourth embodiment of the present invention constructed as above will be omitted here, as it is identical to that of the image forming cartridge 151' of the tandem image forming device of the second embodiment that is described above with reference to FIG. 14, with certain exceptions. For example, when the first, second, third and fourth center shafts 109Y''', 109M''', 109C''' and 109K''' of the first, second, third and fourth photosensitive bodies 101Y''', 101M''', 101C''' and 101K''' are assembled in and disassembled from the first, second, third, and fourth groove 175Y''', 175M''', 175C''', and 175K''' of the shaft receiving part 175''', the second, third and fourth image forming units 110M''', 110C''' and 110K''' are not moved, but only the second, third and fourth center shafts 109M'', 109C'' and 109K'' are displaced.

As apparent from the forgoing description, it can be appreciated that the tandem color image forming device according to the embodiments of the present invention provides that by forming the image forming cartridge to have at least a portion of the center shafts of the photosensitive bodies disposed in the image forming units to be movable when it is assembled in the mounting frame formed in the main body, the center shafts of the photosensitive bodies can be easily assembled in and disassembled from the shaft receiving part of the mounting frame, even though they are fabricated so as to not just join with the shaft receiving part. By doing so, high quality images can be regularly and predictably obtained and the image forming cartridge can be easily fabricated and assembled.

While the embodiments of the present invention have been shown and described with reference to certain embodiments thereof, it will be understood by those skilled in the art that various changes in form and details may be made therein without departing from the spirit and scope of the invention as defined by the appended claims.

What is claimed is:

1. A tandem color image forming device comprising:

an image forming cartridge comprising a cartridge frame having a supporting part adapted to receive a plurality of image forming units in parallel to modularize in a body, and a movable fixing part formed at the cartridge frame and adapted to support at least one of a plurality of center shafts of photosensitive bodies disposed in the plurality of image forming units to be unmovable, but rotatable, and the other of the plurality of the center shafts of the photosensitive bodies to be movable and rotatable when the plurality of image forming units are received in the cartridge frame; and a mounting frame formed at a main body to mount the image forming cartridge therein, and having a shaft receiving part formed at a position corresponding to both ends of the center shafts of the photosensitive bodies of the image forming units to receive the both ends of the center shafts of the photosensitive bodies when the image forming cartridge is mounted in the mounting frame.

2. The device according to claim 1, wherein the movable fixing part comprises:

fixed supporting holes formed at portions of the cartridge frame corresponding to both ends of the at least one of the plurality of center shafts of the photosensitive bodies to fix the both ends of the at least one of the plurality of center shafts of the photosensitive bodies to be unmovable, but rotatable;

motion supporting holes formed at portions of the cartridge frame corresponding to both ends of the other of the plurality of center shafts of the photosensitive bodies to fix the both ends of the rest of the center shafts of the photosensitive bodies to be movable and rotatable; and a movable space formed between the image forming units corresponding to the both ends of the other of the plurality of center shafts of the photosensitive bodies and the supporting part, and between the supporting part and the cartridge frame to enable the image forming units corresponding to the both ends of the other of the plurality of center shafts of the photosensitive bodies to move when the both ends of the other of the plurality of center shafts of the photosensitive bodies move.

3. The device according to claim 2, wherein the motion supporting holes are more magnified in at least one direction than the fixed supporting holes to enable the both ends of the rest of the center shafts of the photosensitive bodies to move in the at least one direction.

4. The device according to claim 3, wherein the fixed supporting holes are formed in a shape of circle, and the motion supporting holes are formed in a shape selected from the group consisting of a ¬-shaped form, a square form, a rectangle form, a circle form, a +-shaped form, a ⊥-shaped form, a ⊢-shaped form, and a |-shaped form.

5. The device according to claim 1, wherein the supporting part comprises:

at least one fixed support fixed at the cartridge frame to support the image forming unit corresponding to the at least one of the plurality of center shafts of the photosensitive bodies to be unmovable; and movable supports fixed at the cartridge frame to be rotatable in a predetermined angle on hinge shafts, to support the image forming units corresponding to the other of the plurality of center shafts of the photosensitive bodies to be movable.

6. The device according to claim 5, wherein the image forming cartridge further comprises:

at least one elastic member elastically pressing the image forming units corresponding to the rest of the center shafts of the photosensitive bodies in the at least one direction to assist a moving of the image forming units corresponding to the other of the plurality of center shafts of the photosensitive bodies in at least one direction.

7. The device according to claim 6, wherein the elastic member comprises;

a plurality of Y axis direction elastic springs disposed between the cartridge frame and the movable supports of the supporting part to move the image forming units corresponding to the rest of the center shafts of the photosensitive bodies in the direction of the Y axis; and a plurality of X axis direction elastic springs disposed between the cartridge frame and a portion of the image forming units corresponding to the rest of the center shafts of the photosensitive bodies to move the portion of the image forming units corresponding to the rest of the center shafts of the photosensitive bodies in the direction of the X axis.

8. The device according to claim 7, wherein both the Y axis direction and the X axis direction elastic springs are formed of an extension spring.

9. The device according to claim 7, wherein the Y axis direction and the X axis direction elastic springs are formed an extension spring and a compression spring, respectively.

10. The device according to claim 1, wherein the shaft receiving part comprises:

a plurality of grooves opened in one direction and formed in a spaced-apart relation on an assembling reference line to align the both ends of the center shafts of the photosensitive bodies of the image forming units.

11. The device according to claim 10, wherein the assembling reference line has a shape of one selected from a group consisting of a straight line and an arc.

12. A tandem color image forming device comprising:

an image forming cartridge comprising a cartridge frame having a supporting part adapted to receive a plurality of image forming units in parallel to modularize in a body, and a movable fixing part adapted to support at least one of center shafts of photosensitive bodies disposed in the plurality of image forming units to be unmovable, but rotatable, and the other of the plurality of center shafts of the photosensitive bodies to be movable and rotatable; and a mounting frame formed at a main body to mount the image forming cartridge therein, and having a shaft receiving part formed fixedly at a position corresponding to both ends of the center shafts of the photosensitive bodies of the image forming units to receive the both ends of the center shafts of the photosensitive bodies when the image forming cartridge is mounted in the mounting frame.

13. The device according to claim 12, wherein the cartridge frame comprises a plurality of partition walls forming one of a plurality of compartments receiving the image forming units, respectively, and a plurality of compartments receiving components to form an image forming unit, respectively.

14. The device according to claim 12, wherein the movable fixing part comprises:

fixed supporting holes formed at at least one of portions of the cartridge frame and portions of a frame of the image forming unit corresponding to both ends of the at least one of the center shafts of the photosensitive bodies to fix the both ends of the at least one of the center shafts of the photosensitive bodies to be unmovable, but rotatable; and motion supporting holes formed at at least one of portions of the cartridge frame and portions of frames of the image forming units corresponding to both ends of the other of the plurality of center shafts of the photosensitive bodies to fix the both ends of the other of the plurality of center shafts of the photosensitive bodies to be movable and rotatable.

15. The device according to claim 14, wherein the motion supporting holes are more magnified in at least one direction than the fixed supporting holes to enable the both ends of the rest of the center shafts of the photosensitive bodies to move in the at least one direction.

16. The device according to claim 15, wherein the fixed supporting holes are formed in a shape of circle, and the motion supporting holes are formed in a shape selected from the group consisting of a ¬-shaped form, a square form, a rectangle form, a circle form, a +-shaped form, a ⊥shaped form, a ⊢-shaped form, and a |-shaped form.

17. The device according to claim 14, wherein the shaft receiving part comprises:

a plurality of grooves opened in one direction and formed in a spaced-apart relation on an assembling reference line to align the both ends of the center shafts of the photosensitive bodies of the image forming units.

18. The device according to claim 17, wherein the assembling reference line is formed to harmonize with one of a line connecting the center shafts of the photosensitive bodies of the image forming units and a line connecting center points of the fixed supporting holes and the motion supporting holes of the movable fixing part.

19. The device according to claim 17, wherein the assembling reference line has a shape selected from the group consisting of a straight line and an arc.

* * * * *